US011776495B2

(12) United States Patent
Ooga

(10) Patent No.: US 11,776,495 B2
(45) Date of Patent: Oct. 3, 2023

(54) DISPLAY DEVICE AND METHOD OF CONTROLLING BACKLIGHT OF DISPLAY DEVICE

(71) Applicant: Shanghai Tianma Micro-Electronics Co., Ltd., Shanghai (CN)

(72) Inventor: Kouichi Ooga, Kanagawa (JP)

(73) Assignee: SHANGHAI TIANMA MICRO-ELECTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/979,135

(22) Filed: Nov. 2, 2022

(65) Prior Publication Data

US 2023/0139266 A1 May 4, 2023

(30) Foreign Application Priority Data

Nov. 4, 2021 (JP) ..... 2021-180517
Aug. 1, 2022 (JP) ..... 2022-122435

(51) Int. Cl.
*G09G 3/34* (2006.01)

(52) U.S. Cl.
CPC ... *G09G 3/3426* (2013.01); *G09G 2320/0686* (2013.01); *G09G 2330/021* (2013.01); *G09G 2360/16* (2013.01)

(58) Field of Classification Search
CPC ..... G09G 3/3406–3426; G09G 2320/0686; G09G 2360/16
See application file for complete search history.

(56) References Cited

U.S. PATENT DOCUMENTS

| | | | | |
|---|---|---|---|---|
| 8,184,088 | B2 * | 5/2012 | Nonaka | G09G 3/3426 345/698 |
| 8,207,953 | B2 | 6/2012 | Yamamura et al. | |
| 10,026,367 | B2 * | 7/2018 | Meng | G09G 3/3426 |
| 10,192,495 | B2 | 1/2019 | Ikeda et al. | |
| 10,360,868 | B2 * | 7/2019 | Liu | G09G 3/3426 |
| 10,650,758 | B2 * | 5/2020 | Zha | G09G 3/342 |
| 10,777,147 | B2 * | 9/2020 | Wu | G09G 3/20 |
| 2009/0002308 | A1 | 1/2009 | Yoshida | |
| 2017/0018231 | A1 * | 1/2017 | Liu | G09G 3/3426 |

* cited by examiner

*Primary Examiner* — Gene W Lee
(74) *Attorney, Agent, or Firm* — NIXON & VANDERHYE

(57) ABSTRACT

A controller acquires video data, determines provisional luminance values for backlight blocks based on the video data, determines an adjustment coefficient for a backlight block of interest selected from the backlight blocks, determines an adjusted luminance value for the backlight block of interest based on the provisional luminance value and the adjustment coefficient for the backlight block of interest, and controls the backlight block of interest in accordance with the adjusted luminance value. In determining the adjustment coefficient, the controller calculates a statistic of provisional luminance values for reference backlight blocks including backlight blocks adjacent to the backlight block of interest, calculates a relative value of the statistic with respect to the provisional luminance value for the backlight block of interest, and determines the adjustment coefficient for the backlight block of interest based on the relative value and a predefined function.

13 Claims, 36 Drawing Sheets

| | | |
|---|---|---|
| LUMI_1 301 | LUMI_2 302 | LUMI_3 303 |
| LUMI_4 304 | **LUMI_SELF 300** | LUMI_5 305 |
| LUMI_6 306 | LUMI_7 307 | LUMI_8 308 |

| | | |
|---|---|---|
| 1<br>301 | 1<br>302 | 1<br>303 |
| 1<br>304 | 1<br>300 | 1<br>305 |
| 1<br>306 | 1<br>307 | 1<br>308 |

FIG. 6A

| | | |
|---|---|---|
| 0<br>301 | 0<br>302 | 0<br>303 |
| 0<br>304 | 1<br>300 | 0<br>305 |
| 0<br>306 | 0<br>307 | 0<br>308 |

FIG. 6B

| | | |
|---|---|---|
| 0.2<br>301 | 0.1<br>302 | 0.2<br>303 |
| 0.15<br>304 | 1<br>300 | 0.1<br>305 |
| 0.2<br>306 | 0.2<br>307 | 0.1<br>308 |

FIG. 6C

| | | | | |
|---|---|---|---|---|
| LUMI_B1 521 | LUMI_B2 522 | LUMI_B3 523 | LUMI_B4 524 | LUMI_B5 525 |
| LUMI_B6 526 | LUMI_A1 511 | LUMI_A2 512 | LUMI_A3 513 | LUMI_B7 527 |
| LUMI_B8 528 | LUMI_A4 514 | LUMI_SELF 500 | LUMI_A5 515 | LUMI_B9 529 |
| LUMI_B10 530 | LUMI_A6 516 | LUMI_A7 517 | LUMI_A8 518 | LUMI_B11 531 |
| LUMI_B12 532 | LUMI_B13 533 | LUMI_B14 534 | LUMI_B15 535 | LUMI_B16 536 |

*FIG. 11*

SECOND BACKLIGHT REGION
350B
FIRST BACKLIGHT REGION
350A
351B
SEGMENTATION BOUNDARY
SEGMENTATION BOUNDARY
351A
0.0
0.0
0.0

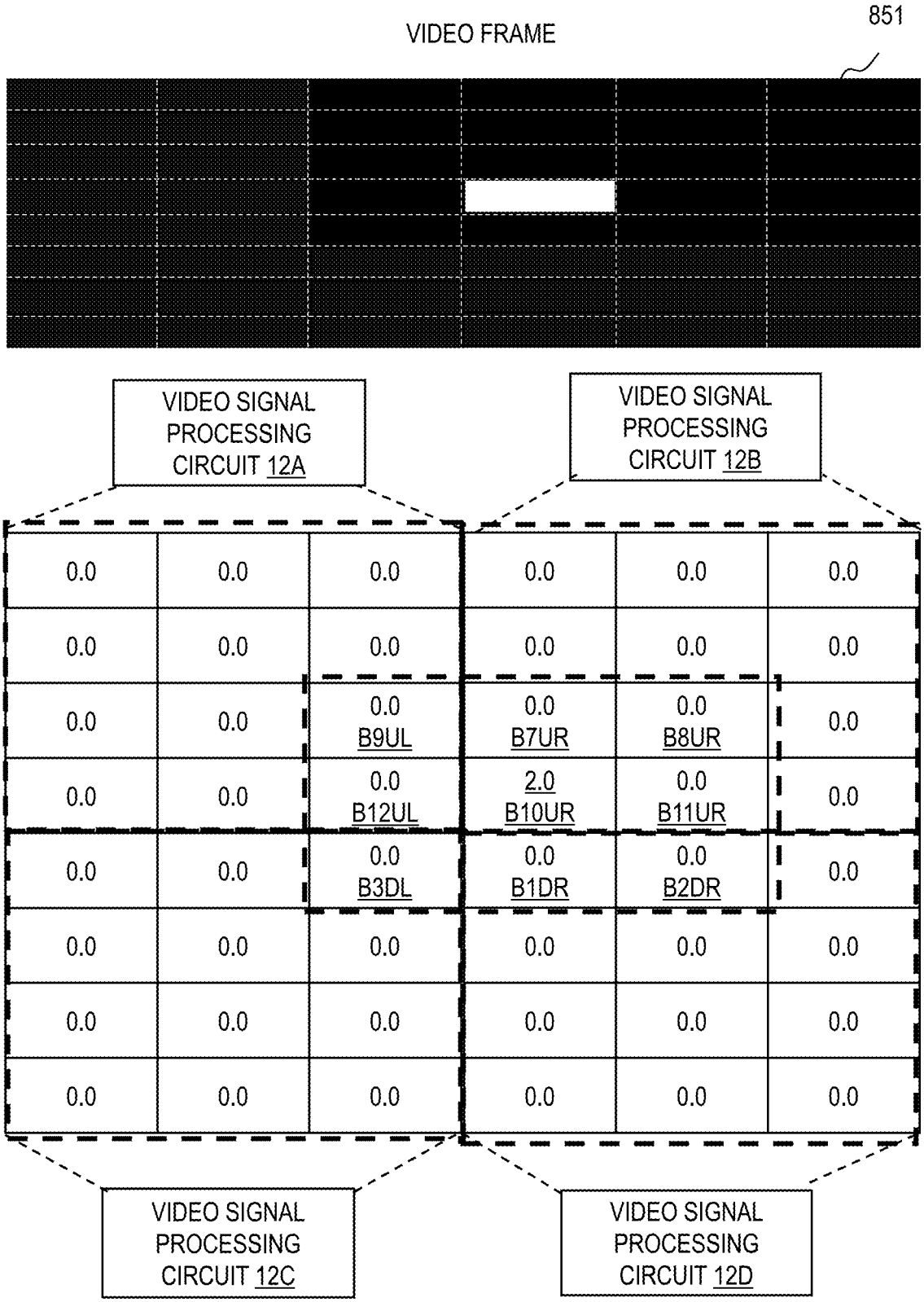
851
VIDEO FRAME
VIDEO SIGNAL PROCESSING CIRCUIT 12A
VIDEO SIGNAL PROCESSING CIRCUIT 12B
0.0
0.0
0.0

DISPLAY DEVICE AND METHOD OF CONTROLLING BACKLIGHT OF DISPLAY DEVICE

CROSS-REFERENCE TO RELATED APPLICATIONS

This non-provisional application claims priority under 35 U.S.C. § 119(a) on Patent Application No. 2021-180517 filed in Japan on Nov. 4, 2021 and Patent Application No. 2022-122435 filed in Japan on Aug. 1, 2022, the entire contents of which are hereby incorporated by reference.

BACKGROUND

This disclosure relates to control of the backlight of a display device.

A technology called local dimming is used to reduce the power consumption of the backlight of a liquid crystal display device and improve the contrast ratio in the displayed image. Local dimming divides the light emitting plane of the backlight into a plurality of blocks and controls whether to increase or decrease the amount of light emission of each block individually depending on the brightness in the video frame.

For example, in displaying a white window in a full black background, the local dimming controls the backlight so that the region (blocks) opposite to the region to display the white window will emit more light (at higher luminance) and the region (blocks) opposite to the region (blocks) to display the background (in black) will emit less light.

Such control achieves reduction in the power for the backlight, compared to the case where the whole region of the backlight lights at 100% all the time. Furthermore, the increased difference in luminance between the region emitting more light and the region emitting less light provides a higher contrast ratio in the same plane, which improves the display quality.

SUMMARY

An aspect of this disclosure is a display device including: a backlight including a plurality of backlight blocks; a display panel configured to display an image with light from the backlight; and a controller. The controller is configured to: acquire video data; determine provisional luminance values for the plurality of backlight blocks based on the video data; determine an adjustment coefficient for a backlight block of interest selected from the plurality of backlight blocks; determine an adjusted luminance value for the backlight block of interest based on the provisional luminance value and the adjustment coefficient for the backlight block of interest; and control the backlight block of interest in accordance with the adjusted luminance value. In determining the adjustment coefficient for the backlight block of interest, the controller is configured to: calculate a statistic of provisional luminance values for a plurality of reference backlight blocks including backlight blocks adjacent to the backlight block of interest; calculate a relative value of the statistic with respect to the provisional luminance value for the backlight block of interest; and determine the adjustment coefficient for the backlight block of interest based on the relative value and a predefined function.

An aspect of this disclosure is a method of controlling a backlight of a display device. The backlight includes a plurality of backlight blocks. The method includes: acquiring video data; determining provisional luminance values for the plurality of backlight blocks based on the video data; determining an adjustment coefficient for a backlight block of interest selected from the plurality of backlight blocks; determining an adjusted luminance value for the backlight block of interest based on the provisional luminance value and the adjustment coefficient for the backlight block of interest; and controlling the backlight block of interest in accordance with the adjusted luminance value. The determining an adjustment coefficient for the backlight block of interest includes: calculating a statistic of provisional luminance values for a plurality of reference backlight blocks including backlight blocks adjacent to the backlight block of interest; calculating a relative value of the statistic with respect to the provisional luminance value for the backlight block of interest; and determining the adjustment coefficient for the backlight block of interest based on the relative value and a predefined function.

It is to be understood that both the foregoing general description and the following detailed description are exemplary and explanatory and are not restrictive of this disclosure.

BRIEF DESCRIPTION OF THE DRAWINGS

FIG. 6A provides a provisional luminance value for a backlight block of interest and provisional luminance values for its reference backlight blocks;

FIG. 6B provides a provisional luminance value for a backlight block of interest and provisional luminance values for its reference backlight blocks;

FIG. 6C provides a provisional luminance value for a backlight block of interest and provisional luminance values for its reference backlight blocks;

FIG. 11 illustrates still another example of the disposition of reference backlight blocks;

FIG. 32 illustrates an example of the relation between a video frame and adjusted luminance values for the corresponding backlight blocks.

EMBODIMENTS

Figure 1:
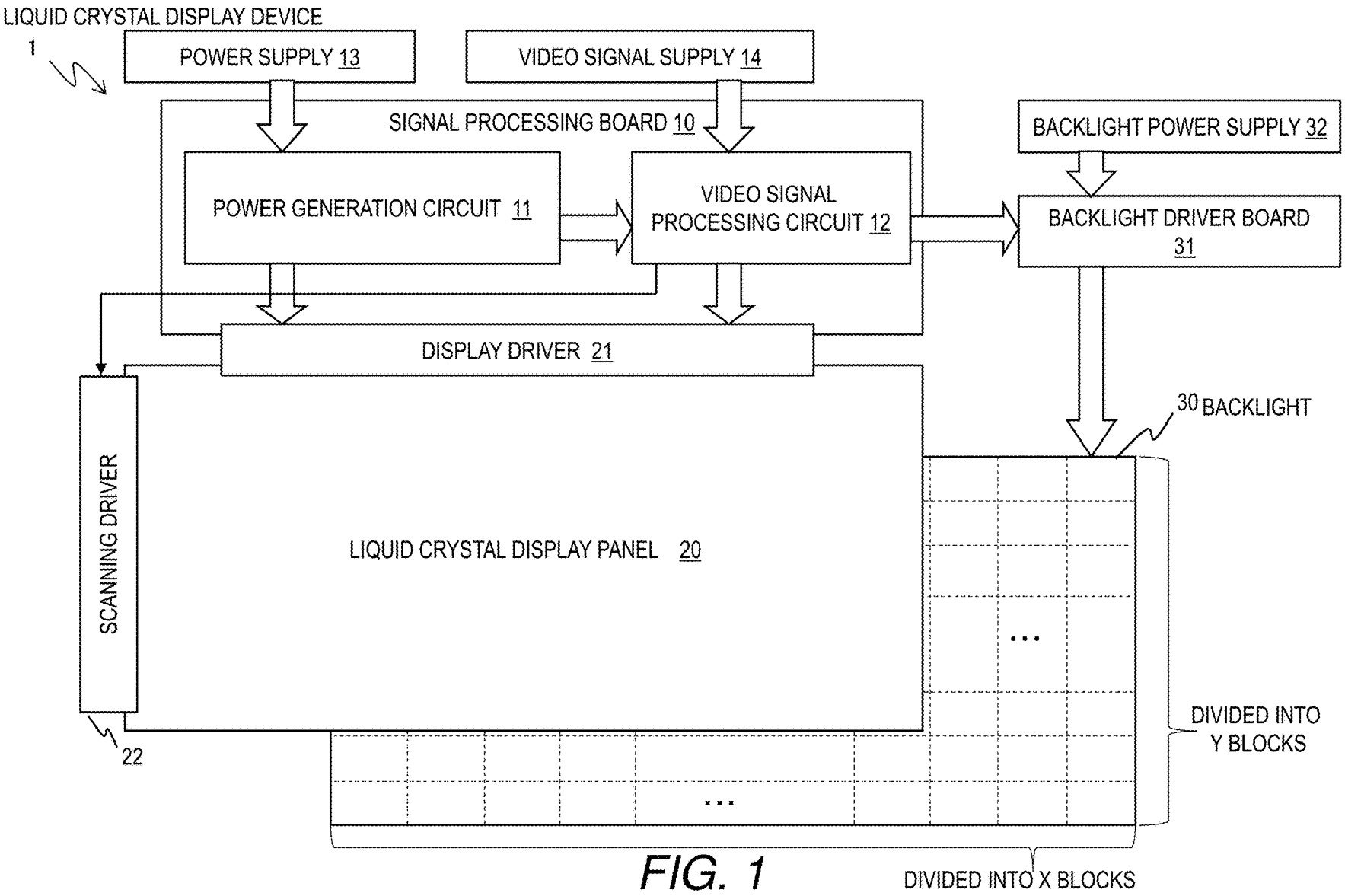
FIG. 1 illustrates a configuration example of a display device in an embodiment of this specification.

Hereinafter, embodiments of this disclosure will be described with reference to the accompanying drawings. It should be noted that the embodiments are merely examples to implement this disclosure and are not to limit the technical scope of this disclosure. Elements common to the drawings are denoted by the same reference signs and some elements in the drawings are exaggerated in size or shape for clear understanding of the description.

A display device in an embodiment of this specification disclosed herein includes a display panel and a backlight including a plurality of backlight blocks. The display device determines provisional luminance values for the individual backlight blocks based on an input video data. The display device adjusts the provisional luminance value for a backlight block of interest based on the provisional luminance value for the backlight block of interest and a statistic of the provisional luminance values for reference backlight blocks including backlight blocks adjacent to the backlight block of interest.

The luminance (frontal luminance) recognized or measured directly above (in front of) a backlight block of interest depends on not only the light emitted from the backlight block of interest but also the light leaking from backlight blocks neighboring the backlight block of interest. Under the condition where the luminance of light emitted from the backlight block of interest is unchanged, the frontal luminance of the backlight block of interest is low when the neighboring backlight blocks are not lit, compared to when they are lit.

Adjusting the provisional luminance value for the backlight block of interest based on a statistic of the provisional luminance values for the reference backlight blocks enables the display device to attain improved display quality and power consumption with a simple configuration.

In an embodiment of this specification, the display device compares the provisional luminance value for the backlight block of interest with a statistic of the provisional luminance values for the reference backlight blocks and determines an adjustment coefficient based on the comparison result and a predefined function. The comparison result in an embodiment of this specification is a value obtained by dividing the statistic of the provisional luminance values for the reference backlight blocks by the provisional luminance value for the backlight block of interest.

The reference backlight blocks can include not only real backlight blocks in the backlight but also virtual backlight blocks. For example, a backlight block of interest located at an end of the backlight does not have a backlight block adjacent thereto outside the backlight.

The display device in an embodiment of this specification defines virtual backlight blocks located outside the backlight as reference backlight blocks for such a backlight block of interest. The provisional luminance value for a virtual backlight block can be determined based on the provisional luminance values for one or more real backlight blocks. The virtual backlight blocks enable adjustment of the luminance value for a backlight block with a simpler configuration.

The display device inputs those values to a predefined function to calculate the adjustment coefficient for adjusting the provisional luminance value for a backlight block of interest. The adjustment coefficient in an embodiment of this specification is an adjustment multiplier. The display device calculates the product of the adjustment multiplier and the provisional luminance value for the backlight block of interest to determine the adjusted luminance value for the backlight block of interest.

The backlight block of interest is controlled in accordance with the adjusted luminance value. The provisional luminance value and the adjusted luminance value can be relative luminance values having a relation proportional to the actual luminance value for the backlight block. For example, the relative luminance value is normalized so that the maximum value is 1 and the minimum value is 0. The actual maximum luminance values of the emitted light can be different among the backlight blocks. When different backlight blocks are assigned the same adjusted luminance value, the luminance values of the emitted light (the luminance values of the light to be recognized) of the backlight blocks can be the same or different. Hereinafter, display devices according to the embodiments of this specification will be described more specifically.

First Embodiment

FIG. 1 illustrates a configuration example of a display device in an embodiment of this specification. The display device displays an image by controlling transmission of light from the backlight. FIG. 1 illustrates a configuration example of a liquid crystal display device 1 as an example of a display device. The liquid crystal display device 1 includes a signal processing board 10, a power supply 13, a video signal supply 14, a liquid crystal display panel 20, a display driver 21, and a scanning driver 22. The liquid crystal display device 1 further includes a backlight 30, a backlight driver board 31, and a backlight power supply 32. The signal processing board 10 includes a power generation circuit 11 and a video signal processing circuit 12. The signal processing board 10, the display driver 21, and the scanning driver 22 can be included in the controller for controlling the liquid crystal display panel 20.

The liquid crystal display device 1 displays a picture in accordance with video data input from the external. The video data includes video frames to be displayed successively. The liquid crystal display panel 20 is disposed in front (on the side to be viewed by the user) of the backlight 30 and controls the amount of the light from the backlight 30 to be transmitted therethrough to display video frames (images) successively input from the external.

The power generation circuit 11 can include a DC-DC converter; it generates and supplies electric power for the other circuits to operate. The video signal processing circuit 12 performs processing involved in displaying a picture, such as generating a signal for displaying an image on the liquid crystal display panel 20 and a signal for controlling the backlight 30. The power supply 13 supplies electric power to the power generation circuit 11. The video signal supply 14 supplies a video signal to the video signal processing circuit 12 in accordance with the video data from the external.

The power generation circuit 11 generates electric power to drive ICs such as the video signal processing circuit 12, the display driver 21, and the scanning driver 22. The display driver 21 and the scanning driver 22 are configured to operate using the power supplied from the power generation circuit 11 to perform their processing.

The display driver 21 generates a data signal from the video signal sent from the video signal processing circuit 12 and supplies the data signal to the liquid crystal display panel 20. The scanning driver 22 selects scanning lines of the liquid crystal display panel 20 one by one in accordance with a timing signal sent from the video signal processing circuit 12. The video signal processing circuit 12 also sends the timing signal to the display driver 21. In accordance with the timing signal, the display driver 21 generates a data signal from the received video signal and supplies the data signal to the liquid crystal display panel 20.

The video signal processing circuit 12 converts the data arrangement of the video signal input from the external to send it to the display driver 21 and generates and sends a timing signal for the display driver 21 and scanning driver 22 to operate, using the power supplied from the power generation circuit 11.

The video signal processing circuit 12 further generates a driving control signal for controlling the driving of a plurality of backlight blocks included in the backlight 30 and sends the driving control signal to the backlight driver board 31. A backlight block can be simply referred to as block. Examples of the driving control signal include a backlight ON/OFF control signal and a dimming control signal. The dimming control signal is a pulse width modulation (PWM) signal for controlling the lighting periods of light sources by time sharing or a signal for controlling the amounts of electric current flowing in the light sources.

The backlight 30 is a planar light source device disposed behind the liquid crystal display panel 20 to emit light required for the liquid crystal display panel 20 to display an image. The backlight driver board 31 includes a backlight driver circuit and controls the lighting (luminance) of the backlight 30 in accordance with the driving control signal sent from the video signal processing circuit 12. The backlight driver board 31 operates using the power supplied from the backlight power supply 32.

The liquid crystal display device 1 employs local dimming. In the configuration example of FIG. 1, the backlight 30 is divided into X blocks (regions) along the X-axis and Y blocks along the Y-axis. Each backlight block has a rectangular shape and the backlight blocks are disposed in a matrix.

The backlight 30 consists of a plurality of backlight block rows. Each backlight block row consists of backlight blocks aligned in the X-axis direction (row direction). In an example, all backlight block rows include the same number of backlight blocks. However, each backlight block row can have a different number of backlight blocks. From another point of view, the backlight 30 consists of a plurality of backlight block columns. Each backlight block column consists of backlight blocks aligned in the Y-axis direction (column direction). All backlight block columns have the same number of backlight blocks. Each backlight block column can have a different number of backlight blocks, although it is stated that all backlight block columns have the same number of backlight blocks for convenience of explanation. The backlight blocks can be disposed in another layout.

The liquid crystal display device 1 can individually control the luminance values (the amounts of light emission) of the (X×Y) blocks. The liquid crystal display device 1 controls whether to increase or decrease the amount of light emission of each block individually depending on the brightness of the pixels in the video frame to reduce the power consumption and improve the contrast ratio.

The backlight 30 can be a direct backlight, which includes a light source array disposed within the backlight plane to be opposite to the liquid crystal display panel 20 and a diffuser panel between the light source array and the liquid crystal display panel 20. A typical example of the light source is an LED. A plurality of LEDs can be disposed in a backlight block. A desirable number of LEDs can be included in one backlight block. An optimum number of LEDs are disposed at optimum locations based on the luminance efficiency and luminance distribution of the LEDs.

Instead of the above-described direct type, the backlight 30 can be of an edge type, which includes a light guide panel and light sources disposed on opposite sides. The light-emitting area of the backlight 30 can be composed of backlight blocks disposed in a matrix or backlight blocks disposed in a horizontal or a vertical line.

The video signal processing circuit 12 generates a driving control signal for controlling the luminance of individual blocks of the backlight 30 and sends the driving control signal to the backlight driver board 31. The backlight driver board 31 drives and controls the light sources (for example, LEDs) of the backlight 30 so that the individual blocks light at the luminance values (the amounts of light emission) specified in the driving control signal from the video signal processing circuit 12.

The video signal processing circuit 12 generates a timing signal for the display driver 21 and the scanning driver 22 in accordance with the timing signal for the input video signal and also, successively sends a signal (frame signal) of each video frame in the video signal to the display driver 21. The frame signal can specify the intensity levels of red (R), green (G), and blue (B) of each pixel in a video frame.

The video signal processing circuit 12 further analyzes the video frame, generates a driving control signal for the backlight 30 to illuminate the liquid crystal display panel 20 from its behind based on the analysis result, and sends the driving control signal to the backlight 30. As described above, the liquid crystal display device 1 employs local dimming. The video signal processing circuit 12 determines provisional luminance values for individual blocks of the backlight 30 based on the analysis result on the video frame.

Furthermore, the video signal processing circuit 12 determines adjusted luminance values for individual backlight blocks based on the provisional luminance values for the backlight blocks. The video signal processing circuit 12 determines the adjusted luminance values to be the luminance values with which to control the light emission of the individual backlight blocks.

In the example described in the following, provisional luminance values are normalized to range from a minimum value of 0 to a maximum value of 1. Then, some adjusted luminance values could be calculated as a value greater than 1. In that case, the adjusted luminance values are normalized to range from a minimum value of 0 to a maximum value of 1, while the provisional luminance values are converted in advance to corresponding relative values. For example, in the case where the largest multiplier to obtain an adjusted luminance value is known as 2, the adjusted luminance value is to be 1 after the maximum provisional luminance value is multiplied by 2. Accordingly, it can be determined in advance that the maximum provisional luminance value is 0.5.

The video signal processing circuit 12 generates driving control signals specifying luminance values corresponding to the adjusted luminance values and outputs them to individual backlight blocks. The relation between the adjusted luminance value and the driving control signal is predetermined for each backlight block. A driving control signal specifies the actual luminance value of light to be emitted from a backlight block. In an example, the driving control signal specifies the duty ratio of the pulse width in the pulse width modulation (PWM) for power control. As described above, the actual luminance values corresponding to the same adjusted luminance value can be determined differently depending on the backlight blocks.

The frontal luminance of a backlight block depends on the luminance of the light emitted by the backlight block and further, the light leaking from backlight blocks neighboring the backlight block. Determining an adjusted luminance value for the backlight block based on the provisional luminance value for the backlight block and the provisional luminance values for the reference backlight blocks neighboring the backlight block leads to high display quality.

Figure 2:
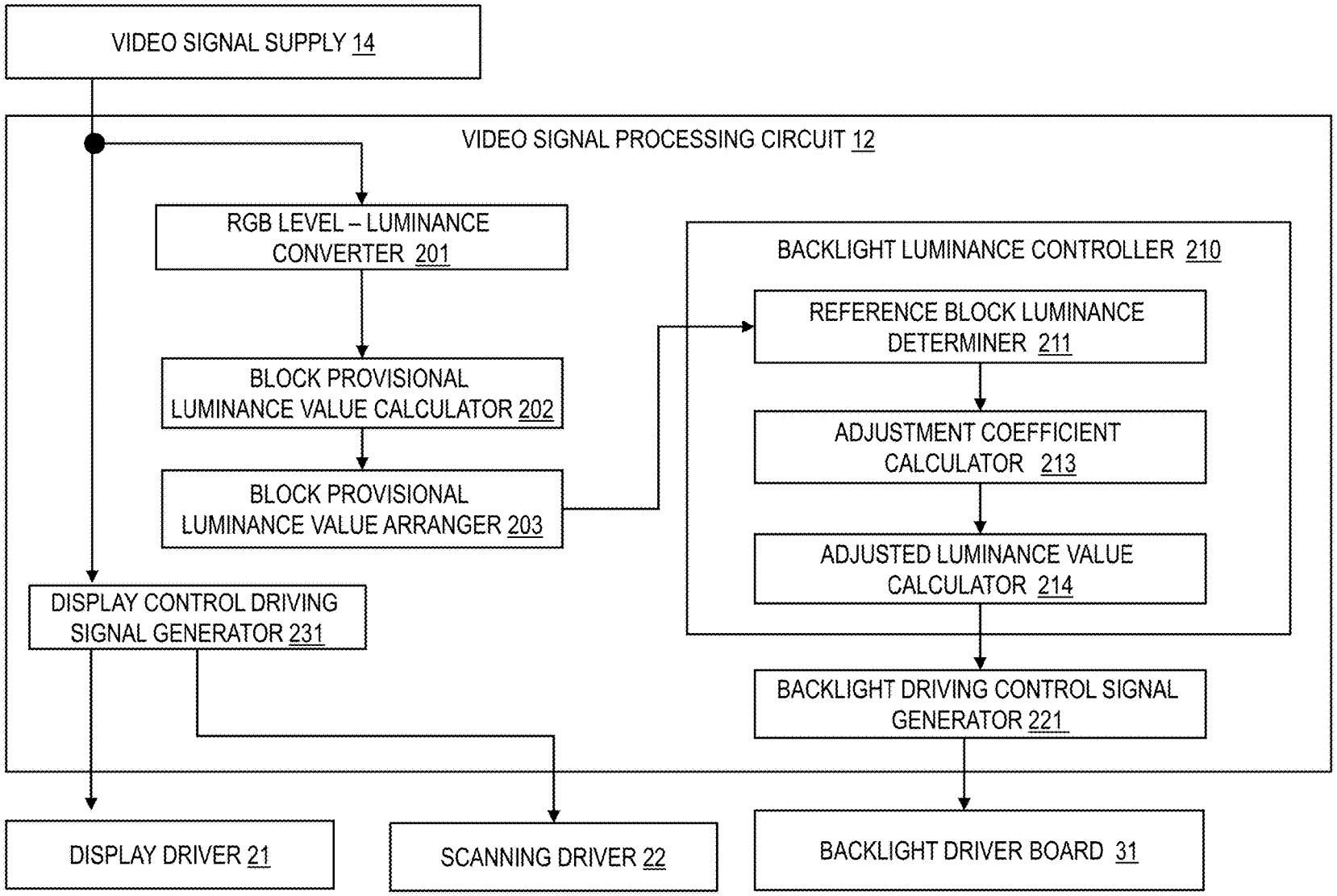
FIG. 2 schematically illustrates an example of the functional configuration of a video signal processing circuit.

Hereinafter, control of the backlight 30 by the video signal processing circuit 12 is described in detail. FIG. 2 schematically illustrates an example of the functional configuration of the video signal processing circuit 12. The video signal processing circuit 12 includes a display control driving signal generator 231, an RGB level-luminance converter 201, a block provisional luminance value calculator 202, a block provisional luminance value arranger 203, a backlight luminance controller 210, and a backlight driving control signal generator 221. The backlight luminance controller 210 includes a reference block luminance determiner 211, an adjustment coefficient calculator 213, and an adjusted luminance value calculator 214.

The display control driving signal generator 231 generates signals to be sent to the display driver 21 and the scanning driver 22 from a video signal received from the video signal supply 14. The display control driving signal generator 231 sends the display driver 21 a signal specifying the RGB intensity levels of each pixel in a video frame together with a timing signal and sends the scanning driver 22 the timing signal.

The RGB level-luminance converter 201, the block provisional luminance value calculator 202, and the block provisional luminance value arranger 203 are circuits for determining provisional luminance values (provisional amounts of light emission) for individual blocks of the backlight 30 based on a video frame. Specifically, the RGB level-luminance converter 201 converts the RGB intensity levels of each pixel specified by the video frame into relative luminance values. The luminance value of a pixel to be used to determine the luminance for the backlight can be the highest luminance value among the values of red, blue, and green components (also referred to as subpixels) constituting the pixel.

The block provisional luminance value calculator 202 determines provisional luminance values for individual blocks of the backlight 30 based on the luminance values of the pixels of the video frame. The block provisional luminance value calculator 202 determines a luminance value determined from the highest luminance value among the luminance values of the pixels in a part (also referred to as display region block) of the display region opposite to a block to be the luminance value for the block. Each backlight block is associated with the display region block opposite to the backlight block.

In the following description, the luminance values of the pixels and the luminance values of the backlight blocks are normalized relative luminance values ranging from 0 to 1. The block provisional luminance value calculator 202 determines the highest value among the luminance values of the pixels in the opposite display region block to be the provisional luminance value for the backlight block. In the case where different backlight blocks are assigned the same provisional luminance value, their actual luminance values may be the same or different because of the individual differences of the blocks or LEDs or the disposition of the blocks, even though the signals for the backlight blocks are the same.

The block provisional luminance value arranger 203 generates an array (distribution) of the provisional luminance values for the backlight blocks calculated by the block provisional luminance value calculator 202. In the array, the provisional luminance values are associated with the blocks of the backlight 30. The block provisional luminance value arranger 203 sends the generated array of provisional luminance values to the backlight luminance controller 210.

The backlight luminance controller 210 adjusts the received provisional luminance values to determine the adjusted luminance values for the backlight blocks. The backlight luminance controller 210 determines adjustment coefficients for the provisional luminance values for the backlight blocks based on the array of provisional luminance values. The details of the adjustment method will be described later.

The backlight driving control signal generator 221 acquires the adjusted luminance values determined for the individual backlight blocks from the backlight luminance controller 210 and generates driving control signals in accordance with the adjusted luminance values. For example, the backlight driving control signal generator 221 generates driving control signals that make the specified luminance values conform to the physical characteristics of the light sources included in individual backlight blocks. The backlight driving control signal generator 221 sends the driving control signals for the individual blocks to the backlight driver board 31.

Hereinafter, an example of the method for the backlight luminance controller 210 to adjust the luminance values for individual blocks of the backlight 30 is described. The backlight luminance controller 210 determines the adjustment amounts for the provisional luminance values determined in accordance with a video frame based on the provisional luminance values. The backlight luminance controller 210 adjusts the provisional luminance values by the adjustment amounts. As a result, the display quality can be improved while saving the power by local dimming.

In an embodiment of this specification, the backlight luminance controller 210 determines the adjusted luminance value for a backlight block of interest based on the provisional luminance value for the backlight block of interest and the provisional luminance values for the reference backlight blocks in a predetermined disposition with respect to the backlight block of interest.

In the example described in the following, the backlight luminance controller 210 adjusts the provisional luminance value for a backlight block of interest, depending on the relative values (comparison values) of the provisional luminance values for the reference backlight blocks to the provisional luminance value for the backlight block of interest. When the provisional luminance values for the reference backlight blocks are smaller, the backlight luminance controller 210 increases the provisional luminance value for the backlight block of interest more. This configuration enables the frontal luminance of each backlight block to get closer to a desired value, in conformance to the distribution of provisional luminance values for the backlight blocks.

The disposition of the reference backlight blocks depends on the design; various patterns can be employed. The reference backlight blocks are composed of neighboring backlight blocks of the backlight block of interest. Some examples will be provided as follows. In one example, the reference backlight blocks are all backlight blocks that are adjacent to the backlight block of interest.

A backlight block adjacent to the backlight block of interest is a backlight block one side or one corner of which is in contact with the backlight block of interest. In the example described in this specification where rectangular backlight blocks are disposed in a matrix, adjacent backlight blocks are the backlight blocks surrounding the backlight block of interest. In the case where the backlight block of interest is located at the center of the backlight 30, the backlight block of interest is surrounded by eight real adjacent backlight blocks.

In another case where the backlight block of interest is located at an end of the backlight 30, real adjacent backlight blocks are located only inside the backlight 30. The reference blocks for a backlight block of interest located at an end can be composed of only the real adjacent backlight blocks or include virtual adjacent backlight blocks, as will be described later.

In the case where the reference backlight blocks are composed of only real backlight blocks, the number of reference backlight blocks for a backlight block of interest located at an end is smaller than eight. In the case where the reference backlight blocks include virtual backlight blocks, the number of reference backlight blocks for any backlight block of interest is eight.

As an option, the reference backlight blocks can be composed of some of the adjacent backlight blocks. For example, the reference backlight blocks can be real backlight blocks that are in contact with the backlight block of interest on its left, right, top, and bottom. The adjacent backlight blocks on the left and right of the backlight block of interest are backlight blocks adjacent along the X-axis (horizontally) and the adjacent backlight blocks on the top and bottom of the backlight block of interest are backlight blocks adjacent along the Y-axis (vertically).

The reference backlight blocks of a backlight block of interest located at an end of the backlight 30 can be composed of real backlight blocks only or both real and virtual backlight blocks. In the case where the reference backlight blocks include virtual backlight blocks, the reference backlight blocks for any backlight block of interest are composed of four adjacent backlight blocks. In the case where virtual backlight blocks are not defined, the number of reference backlight blocks for a backlight block of interest located at an end is smaller than four.

In another example, the reference backlight blocks are composed of the adjacent backlight blocks and their adjacent backlight blocks located outer than the adjacent backlight blocks. In the case of a matrix layout, a backlight block of interest located at the center is surrounded by 24 real reference backlight blocks. The virtual backlight blocks to be referenced for a backlight block of interest located in the vicinity of an end of the backlight 30 can be treated in the same way as the foregoing examples.

The backlight luminance controller 210 in an embodiment of this specification compares a statistic of the provisional luminance values for the reference backlight blocks with the provisional luminance value for the backlight block of interest and adjusts the provisional luminance value for the backlight block of interest based on the comparison result (relative value). The statistic can be an average, such as a simple average or a weighted average, or a median, for example.

In an embodiment of this specification, the backlight luminance controller 210 can use division to compare the provisional luminance values for the reference backlight blocks with the provisional luminance value of a backlight block of interest. For example, a relative value of the provisional luminance value for the backlight block of interest can be calculated by dividing the statistic of the provisional luminance values for the reference backlight blocks by the provisional luminance value for the backlight block of interest. Instead of division, subtraction can be used.

Figure 3:
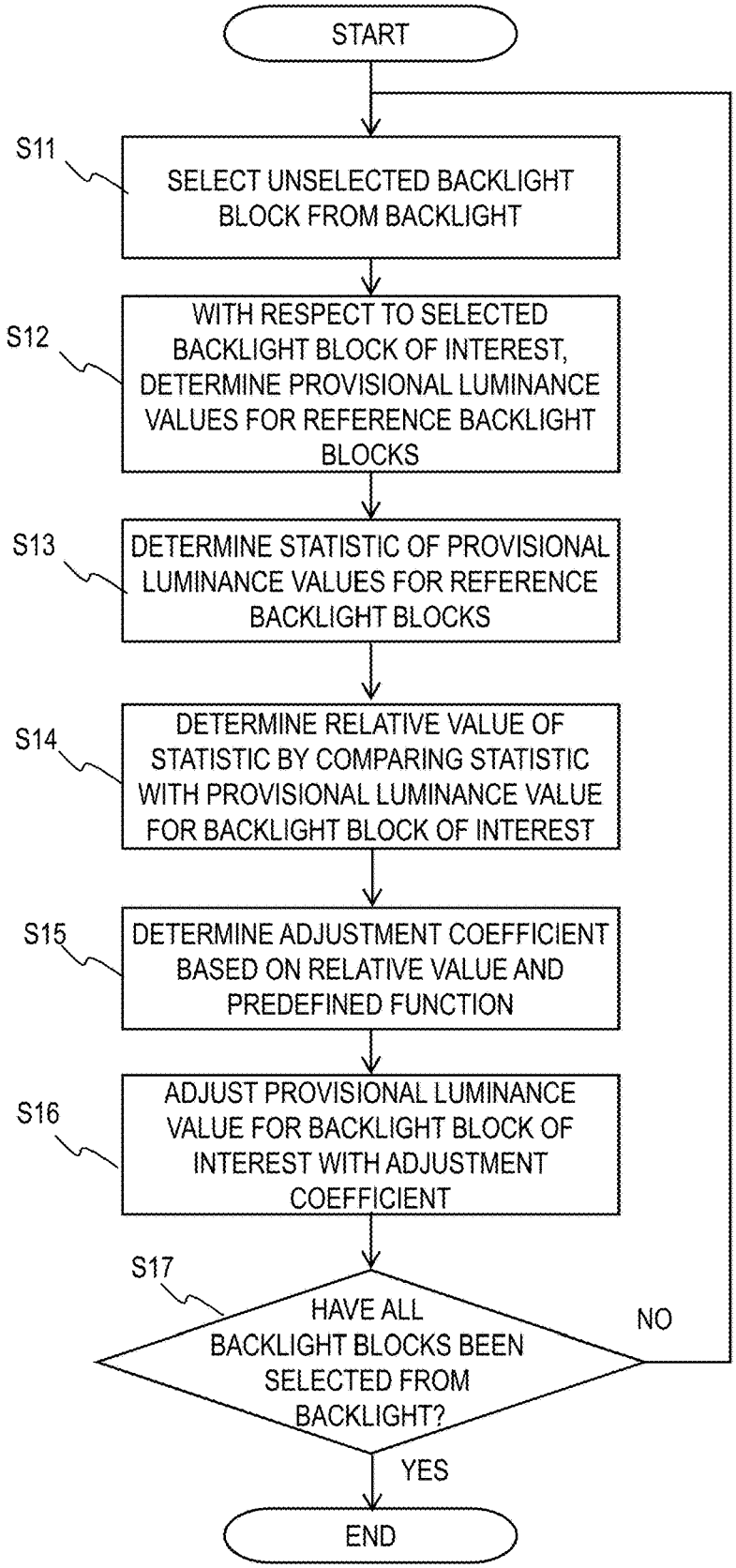
FIG. 3 is a flowchart of an example of processing to determine adjusted luminance values for individual backlight blocks in response to an input video frame.

FIG. 3 is a flowchart of an example of processing to determine adjusted luminance values for individual backlight blocks in response to an input video frame. The reference block luminance determiner 211 selects an unselected backlight block as a backlight block of interest from the backlight 30 (S11). The reference block luminance determiner 211 determines provisional luminance values for the reference backlight blocks of the selected backlight block of interest with reference to the information on the provisional luminance values for the backlight blocks acquired from the block provisional luminance value arranger 203 (S12).

The adjustment coefficient calculator 213 acquires the provisional luminance values for the reference backlight blocks from the reference block luminance determiner 211 and determines their statistic (S13). The statistic can be a simple average, a weighted average, or a median. The adjustment coefficient calculator 213 compares the calculated statistic with the provisional luminance value for the backlight block of interest to determine a relative value of the statistic with respect to the provisional luminance value for the backlight block of interest (S14). An example of the relative value is a value obtained by dividing the statistic by the provisional luminance value for the backlight block of interest.

The adjustment coefficient calculator 213 determines an adjustment coefficient based on the calculated relative value and a predefined function (S15). The function can be expressed by an arithmetic expression or a lookup table, for example. An example of the adjustment coefficient is a multiplier for the provisional luminance value for the backlight block of interest.

The adjusted luminance value calculator 214 adjusts the provisional luminance value for the backlight block of interest with the calculated adjustment coefficient and determines the adjusted luminance value (S16). The driving control signal in accordance with this adjusted luminance value is sent to the backlight driver board 31 to light the backlight block of interest.

The reference block luminance determiner 211 determines whether all backlight blocks of the backlight 30 have been selected (S17). If an unselected backlight block exists (S17: NO), the processing returns to Step S11. If all backlight blocks have been selected (S17: YES), the processing to calculate adjusted luminance values for the backlight blocks for the current video frame ends.

Hereinafter, an example of a method of adjusting the provisional luminance value for a backlight block of interest is described. In the example described in the following, real backlight blocks have identical rectangular shapes and they are disposed in a matrix. Virtual backlight blocks have the same shape as the real backlight blocks. Reference backlight blocks are all real or virtual backlight blocks adjacent to the backlight block of interest. That is to say, the number of reference backlight blocks is eight. In the following description, a backlight block means a real backlight block unless stated specifically.

Figures 4, 5:
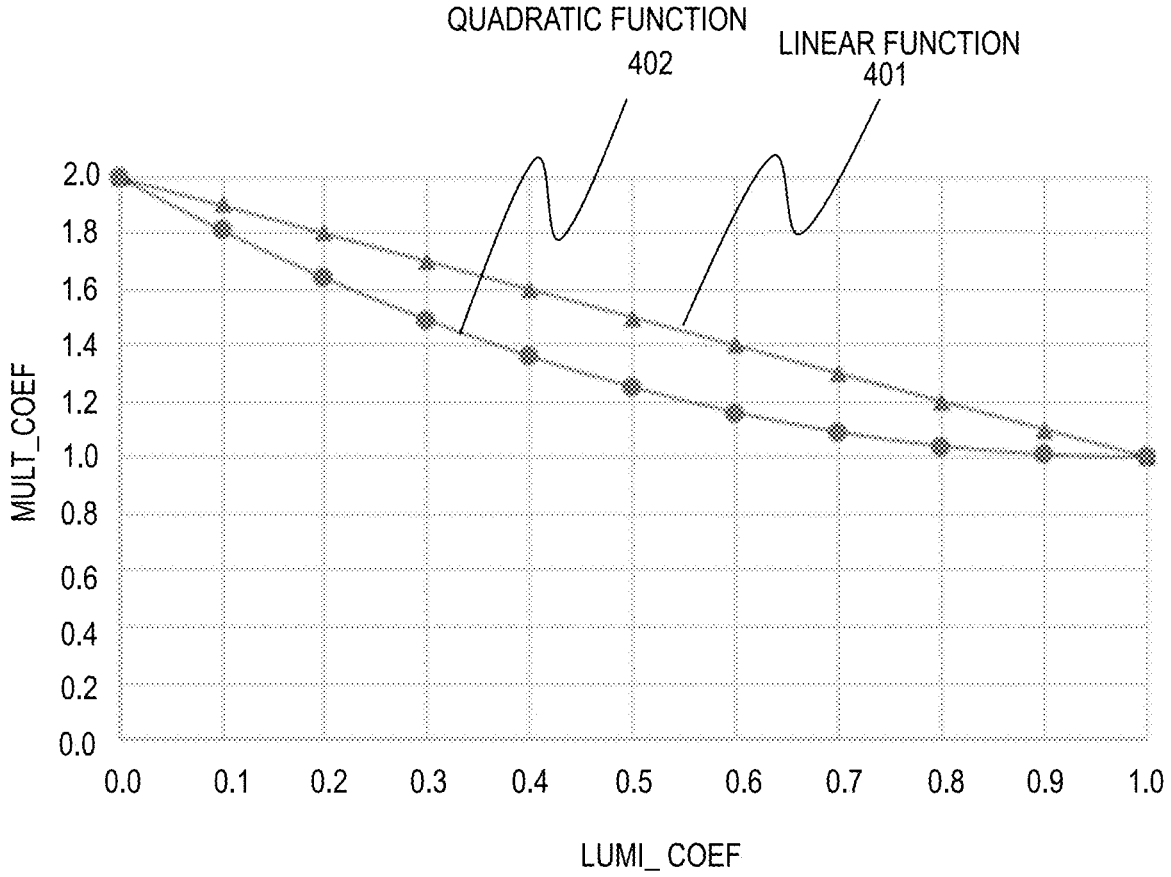
FIG. 4 illustrates a backlight block of interest and the reference backlight blocks therefor.
FIG. 5 provides examples of the function for calculating an adjustment coefficient.

Although X and Y in FIG. 1 can be any natural numbers, the following description will be provided assuming that X is 3 and Y is 3. First, a method of determining an adjusted luminance value for a backlight block of interest located at the center of the backlight 30 is described. FIG. 4 illustrates a backlight block of interest and the reference backlight blocks therefor. The backlight block of interest 300 is surrounded by eight reference backlight blocks 301 to 308. The reference backlight blocks 304 and 305 are horizontally adjacent to the backlight block of interest 300. The reference backlight blocks 302 and 307 are vertically adjacent to the backlight block of interest 300. The reference backlight blocks 301, 303, 306, and 308 are diagonally adjacent to the backlight block of interest 300.

The reference block luminance determiner 211 acquires information on the provisional luminance values for all backlight blocks from the block provisional luminance value arranger 203. The reference block luminance determiner 211 determines the provisional luminance values LUMI_1 to LUMI_8 for the reference backlight blocks 301 to 308 with reference to the information.

The adjustment coefficient calculator 213 calculates a statistic of the provisional luminance values for the reference backlight blocks 301 to 308. This example calculates the simple average AVE_ADJ as expressed by the following formula:

$$AVE_ADJ=(LUMI_1+LUMI_2+LUMI_3+LUMI_4+LUMI_5+LUMI_6+LUMI_7+LUMI_8)/8.$$

Next, the adjustment coefficient calculator 213 compares the statistic AVE_ADJ of the provisional luminance values for the reference backlight blocks with the provisional luminance value LUMI_SELF for the backlight block of interest 300 and calculates a relative value LUMI_COEF of the statistic AVE_ADJ with respect to the provisional luminance value LUMI_SELF for the backlight block of interest 300.

In this example, the adjustment coefficient calculator 213 divides the statistic AVE_ADJ of the provisional luminance values for the reference backlight blocks by the provisional luminance value LUMI_SELF for the backlight block of interest 300 as expressed by the following formula:

$$LUMI_COEF=AVE_ADJ/LUMI_SELF.$$

The maximum value for LUMI_COEF is defined as 1. In other words, if the value of AVE_ADJ/LUMI_SELF is greater than 1, the value of LUMI_COEF is determined to be 1. Further, if the value of LUMI_SELF is 0, the value of LUMI_COEF is determined to be 1.

The adjustment coefficient calculator 213 determines an adjustment coefficient for the provisional luminance value LUMI_SELF for the backlight block of interest 300 from the relative value LUMI_COEF. The adjustment coefficient calculator 213 uses information of a predefined function to calculate the adjustment coefficient from the relative value LUMI_COEF. The function can be expressed by a mathematical expression or a lookup table. For example, the adjustment coefficient MULT_COEF can be calculated by the following linear function:

$$MULT_COEF=A-(A-1)*LUMI_COEF,$$

where the constant A represents the maximum value for the adjustment coefficient.

As described above, the maximum value for the relative value LUMI_COEF is 1. Accordingly, the minimum value for the adjustment coefficient MULT_COEF calculated by the above formula is 1. The function to calculate the adjustment coefficient is not limited to a linear function. For example, a quadratic or higher-order function can be used.

FIG. 5 provides examples of the function to calculate the adjustment coefficient. In the graph, the line 401 represents an example of a linear function and the line 402 represents an example of a quadratic function. The function to calculate the adjustment coefficient can be a higher-order function than a linear function. An example of the high-order function can be expressed as follows:

$$MULT_COEF=1+(A-1)*(ABS(LUMI_COEF-1))\hat{}n,$$

where ABS( ) represents an absolute value and n is a natural number greater than 1. In the case of a quadratic function, n is 2.

The line 401 represents the linear function in accordance with the above formula where the constant A is 2. In either function 401 or 402, the maximum value for the adjustment coefficient MULT_COEF is 2 and the minimum value is 1. As indicated in FIG. 5, the value of the adjustment coefficient MULT_COEF in accordance with the quadratic function 402 is not larger than the value of the adjustment coefficient MULT_COEF in accordance with the linear function 401. The quadratic function can save the power consumption more than the linear function.

Next, the adjusted luminance value calculator 214 adjusts the provisional luminance value LUMI_SELF for the backlight block of interest with the calculated adjustment coefficient MULT_COEF. In this example, the adjustment coefficient MULT_COEF is used as a multiplier to adjust the provisional luminance value LUMI_SELF. In other words, the adjusted luminance value calculator 214 multiplies the provisional luminance value LUMI_SELF by the adjustment coefficient MULT_COEF to calculate the adjusted luminance value for the backlight block of interest.

In the above-described example, when the statistic of the provisional luminance values for the reference backlight blocks is equal to or larger than the provisional luminance value for the backlight block of interest, the relative value LUMI_COEF is 1. In this case, the adjustment coefficient is 1 and the adjustment amount for the provisional luminance value for the backlight block of interest is 0. In other words, the provisional luminance value for the backlight block of interest is maintained.

When the statistic of the provisional luminance values for the reference backlight blocks is smaller than the provisional luminance value for the backlight block of interest, the adjustment coefficient is greater than 1. The smaller the statistic of the provisional luminance values for the reference backlight blocks, the greater the adjustment coefficient. As understood from this description, when the amount of light leaking from the reference backlight blocks is smaller, the provisional luminance value for the backlight block of interest is increased more. This configuration enables the luminance value for the backlight block of interest to be determined more appropriately depending on the amount of light leaking from the reference backlight blocks.

Hereinafter, specific examples of adjustment of the provisional luminance value for a backlight block of interest with the linear function 401 in FIG. 5 are described. To be adjusted is the provisional luminance value LUMI_SELF for the backlight block of interest 300 in FIG. 4.

FIG. 6A provides a provisional luminance value for the backlight block of interest 300 and provisional luminance values for its reference backlight blocks 301 to 308. In the example of FIG. 6A, the provisional luminance values for the backlight block of interest 300 and the reference backlight blocks 301 to 308 are all 1.

The simple average AVE_ADJ of the provisional luminance values for the reference backlight blocks 301 to 308 is 8/8=1. The relative value LUMI_COEF of the statistic of the provisional luminance values for the reference backlight blocks with respect to the provisional luminance value for the backlight block of interest 300 is 1/1=1. Accordingly, the adjustment coefficient (multiplier) MULT_COEF is (2−(2−1)*1)=1.

FIG. 6B provides a provisional luminance value for the backlight block of interest 300 and provisional luminance values for its reference backlight blocks 301 to 308. In the example of FIG. 6B, the provisional luminance value for the backlight block of interest 300 is 1 and the provisional luminance values for the reference backlight blocks 301 to 308 are 0.

The simple average AVE_ADJ of the provisional luminance values for the reference backlight blocks 301 to 308 is 0/8=0. The relative value LUMI_COEF of the statistic of the reference backlight blocks with respect to the provisional luminance value for the backlight block of interest 300 is 0/1=0. Accordingly, the adjustment coefficient (multiplier) MULT_COEF is (2−(2−1)*0)=2.

FIG. 6C provides a provisional luminance value for the backlight block of interest 300 and provisional luminance values for its reference backlight blocks 301 to 308. In the example of FIG. 6C, the provisional luminance value for the backlight block of interest 300 is 1 and the provisional luminance values for the reference backlight blocks 301 to 308 are as shown in FIG. 6C.

The simple average AVE_ADJ of the provisional luminance values for the reference backlight blocks 301 to 308 is 1.25/8=0.15625. The relative value LUMI_COEF of the statistic of the provisional luminance values for the reference backlight blocks with respect to the provisional luminance value for the backlight block of interest 300 is 0.15625/1=0.15625. Accordingly, the adjustment coefficient (multiplier) MULT_COEF is (2−(2−1)*0.15625)=1.84375.

Next, a method of adjusting the provisional luminance value for a backlight block of interest located at an end of the backlight 30 is described. The example described in the following defines virtual backlight blocks and includes real backlight blocks and virtual backlight blocks in the reference backlight blocks. Defining virtual backlight blocks enables the provisional luminance values for all real backlight blocks to be adjusted with the same calculation method.

In other words, all provisional luminance values can be adjusted with a single operational circuit or operation code.

The reference backlight blocks are eight backlight blocks adjacent to the backlight block of interest, like those in the example described with reference to FIG. 4. Some of the eight backlight blocks are real backlight blocks and the remaining backlight blocks are virtual backlight blocks. The provisional luminance value for a backlight block located at an end can be adjusted based on the provisional luminance values of less than eight real backlight blocks. In that case, the calculation method of the adjustment coefficient is determined differently depending on the location of the backlight block.

Figure 7A:
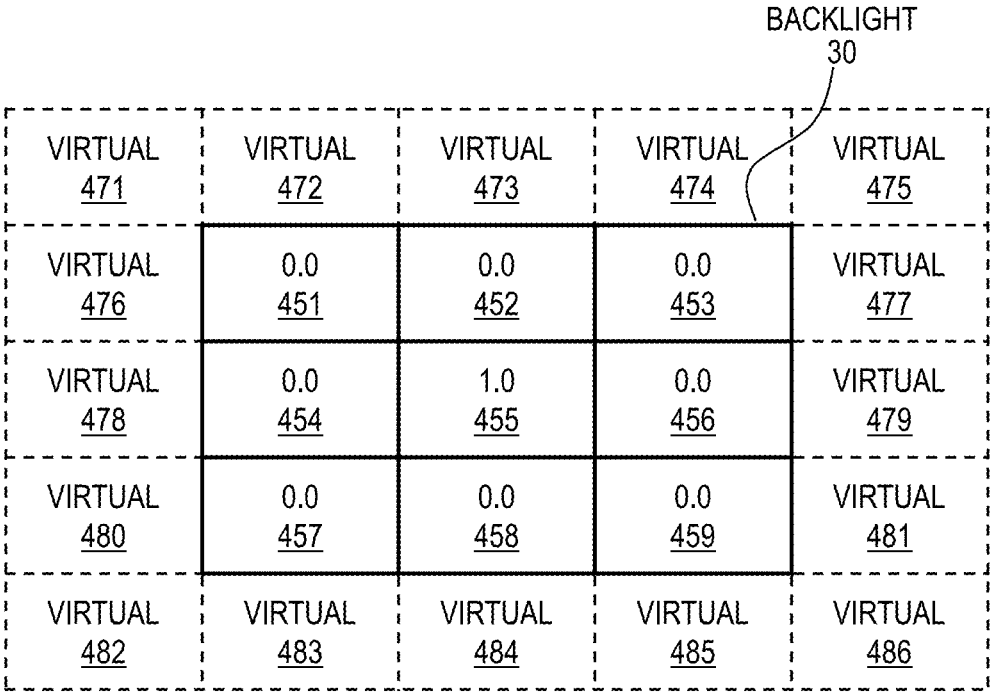
FIG. 7A illustrates an example of real backlight blocks included in a backlight and virtual backlight blocks.

FIG. 7A illustrates an example of real backlight blocks included in the backlight 30 and virtual backlight blocks. The backlight 30 consists of real backlight blocks 451 to 459. Virtual backlight blocks 471 to 486 are defined around the real backlight blocks 451 to 459.

In the configuration example of FIG. 7A, the provisional luminance value for the real backlight block 455 is 1.0 and the provisional luminance values of the other real backlight blocks are 0.0. The provisional luminance values for the virtual backlight blocks 471 to 486 have not been determined yet.

The reference block luminance determiner 211 determines provisional luminance values for the virtual backlight blocks 471 to 486 based on the provisional luminance values for the real backlight blocks 451 to 459. In an embodiment of this specification, the provisional luminance value for a virtual backlight block is the same as the provisional luminance value for the real backlight block closest to the virtual backlight block. Hence, an appropriate provisional luminance value for a virtual backlight block is determined.

Figure 7B:
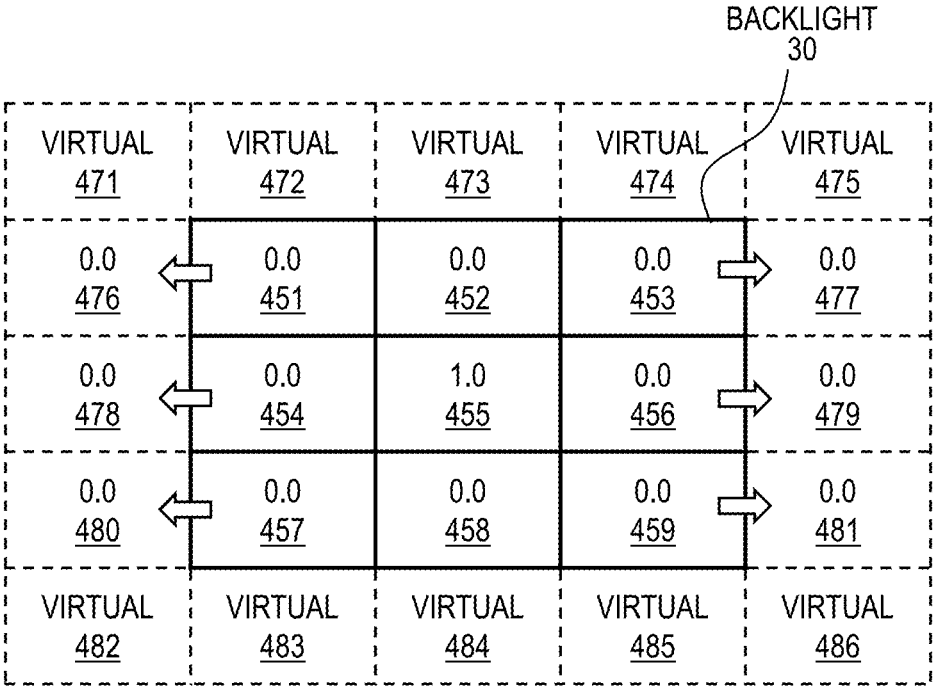
FIG. 7B illustrates a method of determining provisional luminance values for some virtual backlight blocks.

FIG. 7B illustrates a method of determining provisional luminance values for the virtual backlight blocks 476 to 481. The reference block luminance determiner 211 determines the provisional luminance value for the virtual backlight block 476 to be the provisional luminance value for the real backlight block 451 adjacent thereto on the right. In similar, the provisional luminance values for the virtual backlight blocks 478 and 480 are determined to be the provisional luminance values for the real backlight blocks 454 and 457 adjacent thereto on the right.

The reference block luminance determiner 211 determines the provisional luminance value for the virtual backlight block 477 to be the provisional luminance value for the real backlight block 453 adjacent thereto on the left. In similar, the provisional luminance values for the virtual backlight blocks 479 and 481 are determined to be the provisional luminance values for the real backlight blocks 456 and 459 adjacent thereto on the left.

Figure 7C:
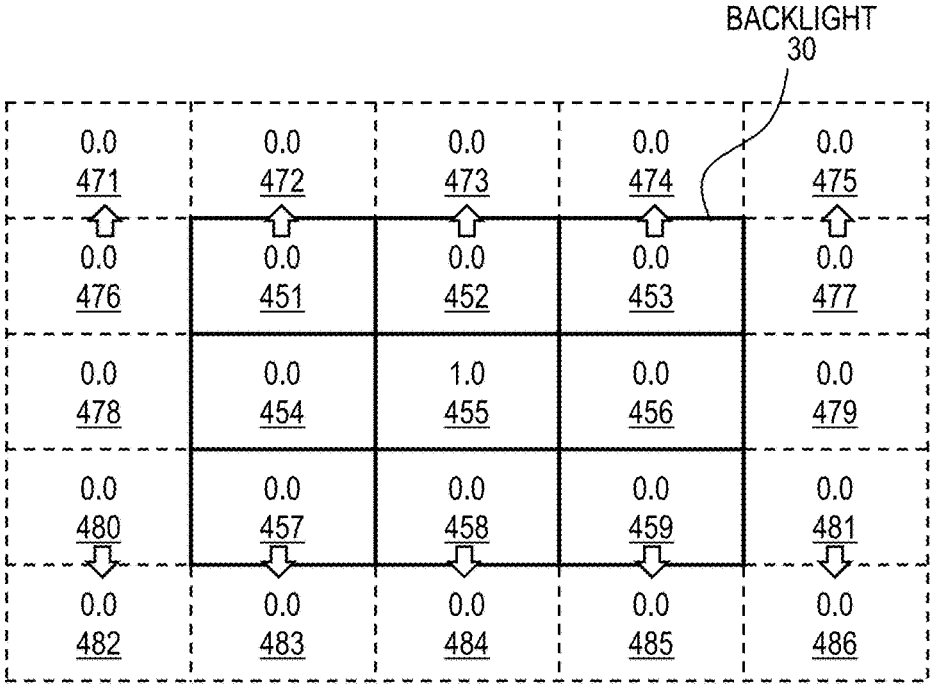
FIG. 7C illustrates a method of determining provisional luminance values for the other virtual backlight blocks.

FIG. 7C illustrates a method of determining provisional luminance values for the virtual backlight blocks 471 to 475 and 482 to 486. The reference block luminance determiner 211 determines the provisional luminance value for the virtual backlight block 472 to be the provisional luminance value for the real backlight block 451 adjacent to its bottom. In similar, the provisional luminance values for the virtual backlight blocks 473 and 474 are determined to be the provisional luminance values for the real backlight blocks 452 and 453 adjacent to their bottoms.

The provisional luminance values for the virtual backlight blocks 471 and 475 are determined to be the provisional luminance values for the virtual backlight blocks 476 and 477 adjacent to their bottoms. In other words, the provisional luminance values for the virtual backlight blocks 471 and 475 are determined to be the provisional luminance values for their closest adjacent backlight blocks 451 and 453.

The reference block luminance determiner 211 determines the provisional luminance value for the virtual backlight block 483 to be the provisional luminance value for the real backlight block 457 adjacent to its top. In similar, the provisional luminance values for the virtual backlight blocks 484 and 485 are determined to be the provisional luminance values for the real backlight blocks 458 and 459 adjacent to their tops.

The provisional luminance values for the virtual backlight blocks 482 and 486 are determined to be the provisional luminance values for the virtual backlight blocks 480 and 481 adjacent to their tops. In other words, the provisional luminance values for the virtual backlight blocks 482 and 486 are determined to be the provisional luminance values for their closest adjacent backlight blocks 457 and 459.

Figure 8:
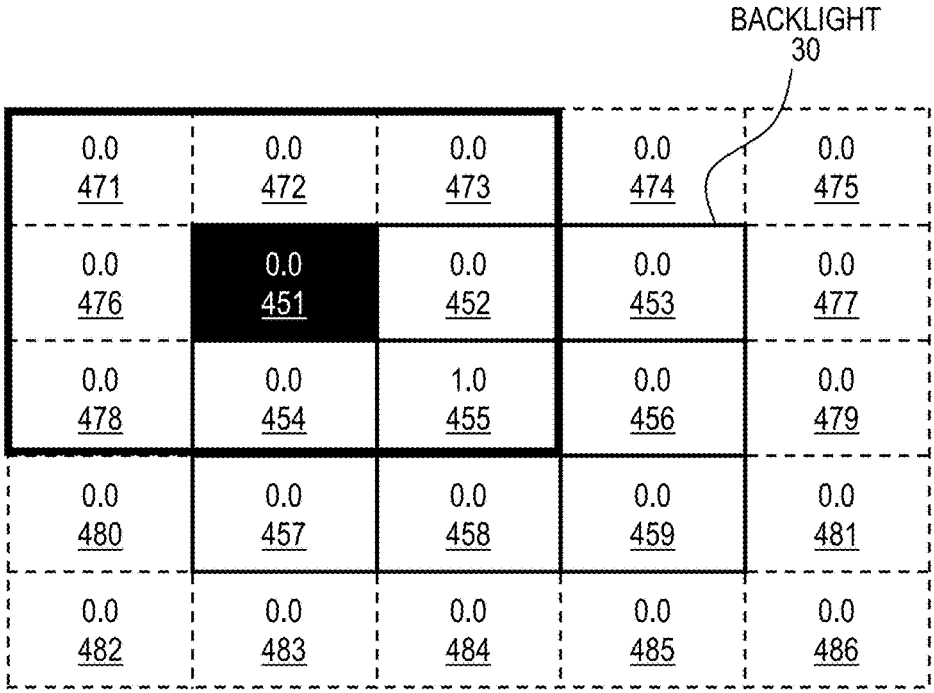
FIG. 8 is a diagram for explaining a method of determining an adjustment coefficient for a backlight block of interest.

An example of determining the adjustment coefficient for a backlight block of interest located at an end of the backlight 30 is described. FIG. 8 is a diagram for explaining the method of determining the adjustment coefficient for the backlight block of interest 451. The backlight block of interest 451 is located at the upper left corner of the backlight 30.

The reference backlight blocks for the backlight block of interest 451 are the virtual backlight blocks 471 to 473, 476, and 478, and the real backlight blocks 452, 454, and 455.

The provisional luminance value for the backlight block of interest 451 is 0.0 and the provisional luminance value for the reference backlight block 455 is 1.0. The provisional luminance values for the other reference backlight blocks are 0.0. The simple average AVE_ADJ of the provisional luminance values for the reference backlight blocks 471 to 473, 476, 452, 478, 454, and 455 is 1/8=0.125. Since the provisional luminance value for the backlight block of interest 451 is 0.0, the relative value LUMI_COEF of the statistic of the provisional luminance values for the reference backlight blocks is 1. Accordingly, the adjustment coefficient (multiplier) MULT_COEF is (2−(2−1)*1)=1.

Second Embodiment

Hereinafter, other examples of the method of determining an adjusted luminance value for a backlight block of interest are described. In the examples described in the following, the virtual backlight blocks to be referenced for a backlight block located at an end of the backlight can be treated in the same way as described in the first embodiment.

Figure 9:
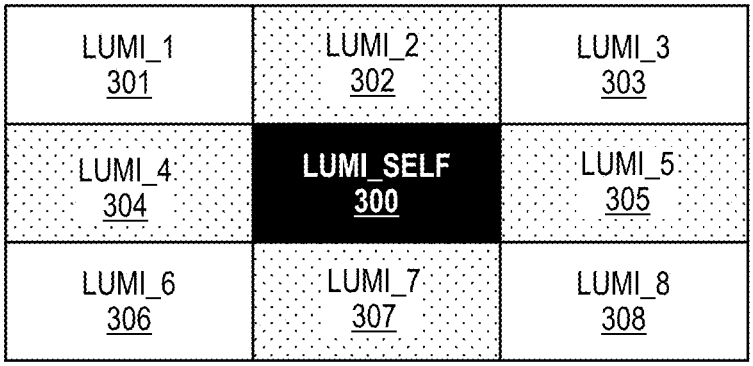
FIG. 9 is a diagram for explaining an example of the method of determining an adjusted luminance value for a backlight block of interest.

FIG. 9 is a diagram for explaining an example of the method of determining an adjusted luminance value for a backlight block of interest. Like in the example described with reference to FIG. 4, all backlight blocks adjacent to the backlight block of interest are referenced to adjust the provisional luminance value for the backlight block of interest.

In the example of FIG. 9, the statistic about the reference backlight blocks is a weighted average. The other points are the same as those in the example described with reference to FIG. 4. This example assigns a smaller weight to diagonally adjacent backlight blocks 301, 303, 306, and 308 than horizontally or vertically adjacent backlight blocks 302, 304, 305, and 307. Assigning a smaller weight to the backlight blocks far from the backlight block of interest enables the individual amounts of light leaking from the reference backlight blocks to be referenced more appropriately.

The weights are determined appropriately depending on the design. The weights for the horizontally or vertically adjacent backlight blocks 302, 304, 305, and 307 are the same and the weights for the diagonally adjacent backlight blocks 301, 303, 306, and 308 are the same.

The weighted average WAVE_ADJ can be calculated by the following formula:

$$WAVE_ADJ=B(LUMI_1+LUMI_3+LUMI_6+LUMI_8)+C(LUMI_2+LUMI_4+LUMI_5+LUMI_7))/8,$$

where B and C are weighting coefficients determined appropriately depending on the design.

In the case of using the function provided in FIG. 5, a relation of (B+C)=2 can be satisfied. For example, B is 1.25 and C is 0.75.

Figure 10:
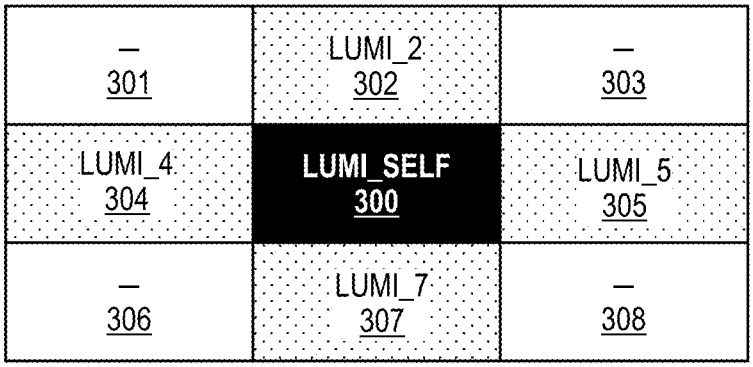
FIG. 10 illustrates another example of the disposition of reference backlight blocks.

FIG. 10 illustrates another example of the disposition of reference backlight blocks. Compared to the example in FIG. 4, the backlight blocks diagonally adjacent to the backlight block of interest are excluded from the reference backlight blocks. In other words, the reference backlight blocks are composed of only horizontally or vertically adjacent backlight blocks.

The method of calculating an adjustment coefficient from the provisional luminance values for the reference backlight blocks and the provisional luminance value for the backlight block of interest illustrated in FIG. 10 can be the same as the method described with reference to FIG. 4. That is to say, the average of the provisional luminance values for the reference backlight blocks 302, 304, 305, and 307 is calculated and the adjustment coefficient is calculated from the average and the provisional luminance value for the backlight block of interest 300 with a predefined function.

Calculating the adjustment coefficient from the provisional luminance values for the reference backlight blocks in FIG. 10 is equivalent to assigning 0 to the weighting coefficient for the diagonally adjacent backlight blocks in the example described with reference to FIG. 9.

FIG. 11 illustrates still another example of the disposition of reference backlight blocks. The reference backlight blocks in this example includes outer backlight blocks 521 to 536 in addition to the backlight blocks 511 to 518 adjacent to the backlight block of interest 500. The outer backlight blocks 521 to 536 are adjacent to the backlight blocks 511 to 518 that are adjacent to the backlight block of interest 500.

Calculating the statistic about the reference backlight blocks includes the provisional luminance values for the outer backlight blocks 521 to 536 in addition to the provisional luminance values for the adjacent backlight blocks 511 to 518.

In the case where the statistic is a weighted average, the weight for the outer backlight blocks 521 to 536 can be determined to be smaller than the weight for the adjacent backlight blocks 511 to 518. This is because the outer backlight blocks 521 to 536 are located farther from the backlight block of interest 500 than the adjacent backlight blocks 511 to 518. Hence, a statistic consistent with the amounts of light leaking from the reference backlight blocks to the backlight block of interest can be calculated.

The weighted average can be calculated by the following formula:

$$WAVE_ADJ2=(D(LUMI_A1+LUMI_A2+LUMI_A3+LUMI_A4+LUMI_A5+LUMI_A6+LUMI_A7+LUMI_A8)+E(LUMI_B1+LUMI_B2+LUMI_B3+LUMI_B4+LUMI_B5+LUMI_B6+LUMI_B7+LUMI_B8+LUMI_B9+LUMI_B10+LUMI_B11+LUMI_B12+LUMI_B13+LUMI_B14+LUMI_B15+LUMI_B16))/24,$$

where D and E are weighing coefficients that are determined appropriately depending on the design.

In the case of using the function provided in FIG. 5, a relation of (D+E)=2 can be satisfied.

Like the example described with reference to FIG. 9, the four backlight blocks located at a corner among the adjacent backlight blocks 511 to 518 can be assigned a weight smaller than the weight for the other backlight blocks. The same applies to the outer backlight blocks 521 to 536. The methods of calculating the relative value of the statistic of the provisional luminance values for the reference backlight blocks with respect to the provisional luminance value for the backlight block of interest and the adjustment coefficient can be the same as those in the first embodiment.

Examples of Calculation of Frontal Luminance

Hereinafter, examples of frontal luminance values of the backlight blocks acquired by the adjusted luminance values determined in accordance with the method of the first embodiment are described. As described in the following, the methods according to the embodiments of this specification attain desired frontal luminance values directly above the individual backlight blocks.

In the examples described in the following, reference backlight blocks are the eight backlight blocks adjacent to the backlight block of interest. The statistic of the provisional luminance values for the reference backlight blocks is a simple average and the relative value is a value obtained by dividing the simple average of the provisional luminance values for the reference backlight blocks by the provisional luminance value for the backlight block of interest. The adjustment coefficient is calculated using the linear function described with reference to FIG. 5 and it is a multiplier for the provisional luminance value for the backlight block of interest.

Figure 12A:
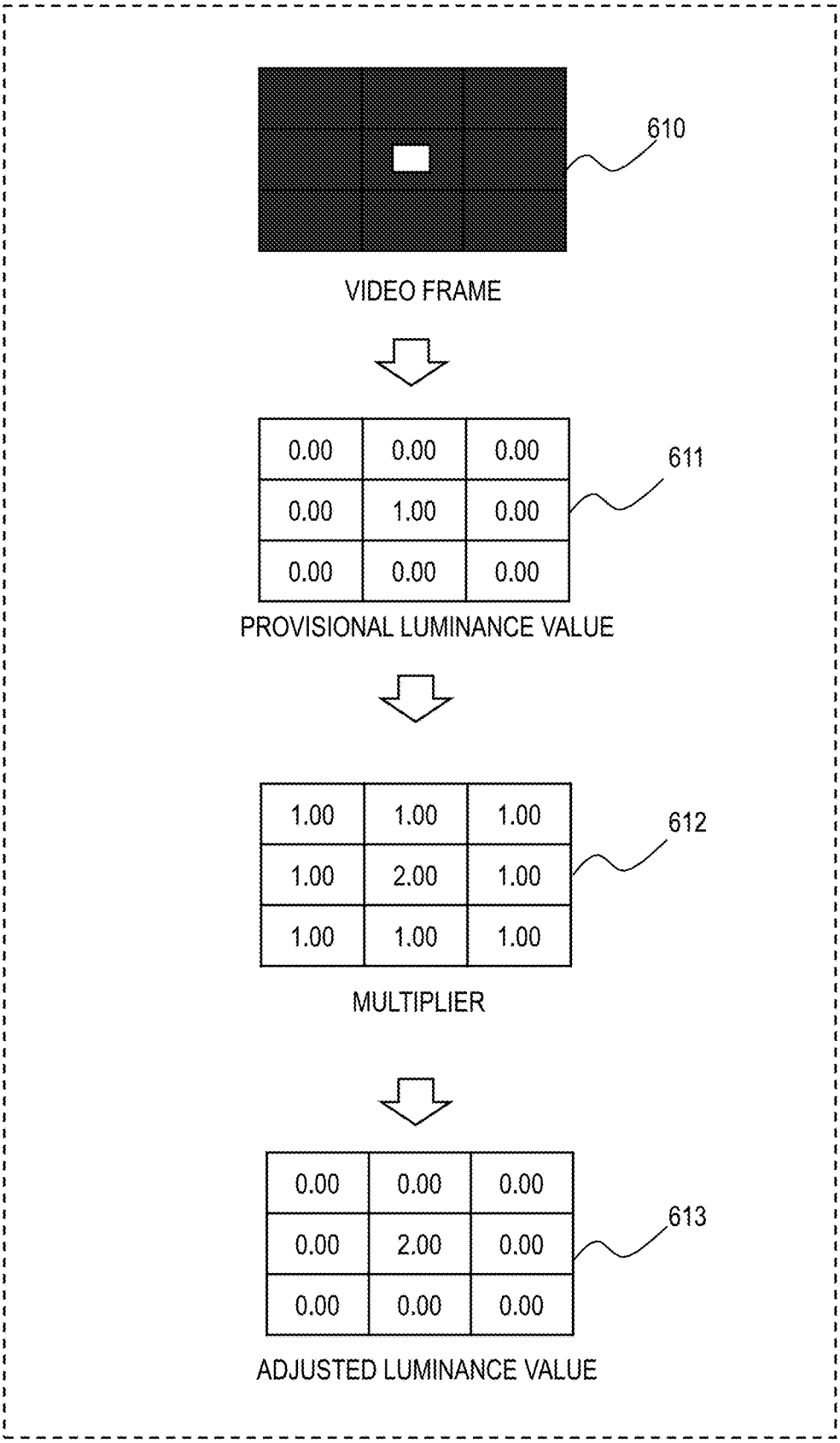
FIG. 12A provides the luminance distribution of a video frame, and a provisional luminance value distribution, a multiplier distribution, and an adjusted luminance value distribution to the backlight blocks obtained from the luminance distribution of the video frame.

FIG. 12A provides a luminance distribution 610 of a video frame, and a provisional luminance value distribution 611, a multiplier distribution 612, and an adjusted luminance value distribution 613 to the backlight blocks obtained from the luminance distribution 610. The term "distribution" in "luminance distribution" or "provisional luminance value distribution" does not mean the information on luminance gradient (luminance distribution) in each backlight block when the backlight block is lit but means a set (array) of luminance values assigned to the backlight blocks.

The video frame 610 consists of an area where the relative luminance value is 1.0 and its surrounding area where the relative luminance value is 0.0. The area at the relative luminance value of 1.0 faces only one backlight block located at the center. Accordingly, in the backlight block set, the provisional luminance value for the central backlight block is 1.00 and the provisional luminance values for the other backlight blocks are 0.00. The multipliers as adjustment coefficients for the backlight blocks are as indicated in the multiplier distribution 612. As a result, the adjusted luminance value distribution 613 to the backlight blocks is obtained.

Figure 12B:
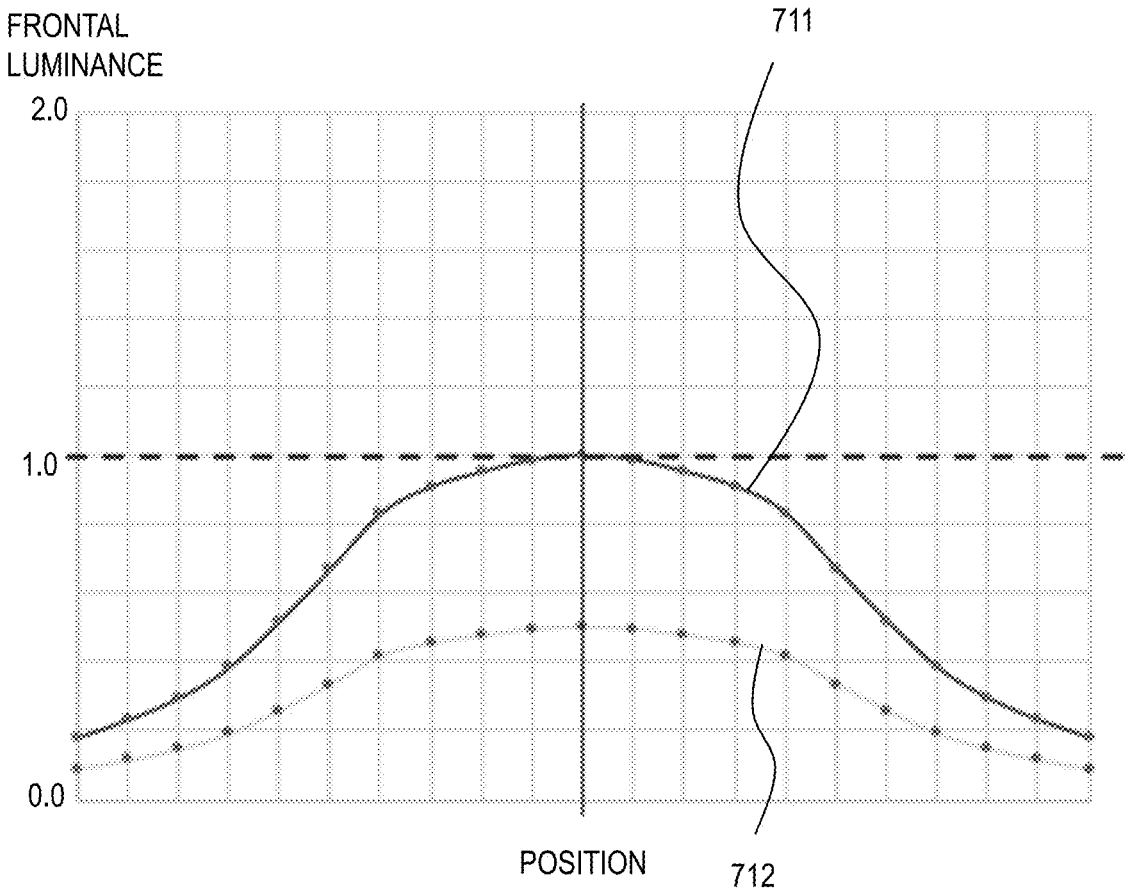
FIG. 12B provides a graph representing the frontal luminance distribution generated by the backlight blocks controlled in accordance with the adjusted luminance value distribution in FIG. 12A.

FIG. 12B provides a graph representing the frontal luminance distribution generated by the backlight blocks controlled in accordance with the adjusted luminance value distribution 613. The horizontal axis of the graph represents the position on the X-axis at the center of the Y-axis in the main face of the backlight. The vertical axis represents frontal luminance. The frontal luminance value of 1.0 means the desired frontal luminance value.

Regarding the example of FIG. 12A, the desired frontal luminance value for the central backlight block is 1.0 and the desired frontal luminance values for the other backlight blocks are 0.0. The line 711 represents the frontal luminance value of the backlight controlled in accordance with the adjusted luminance values and the line 712 represents the frontal luminance value of the backlight controlled in accordance with the provisional luminance values. The backlight controlled in accordance with the adjusted luminance values attains frontal luminance values closer to the desired frontal luminance values.

Figure 13A:
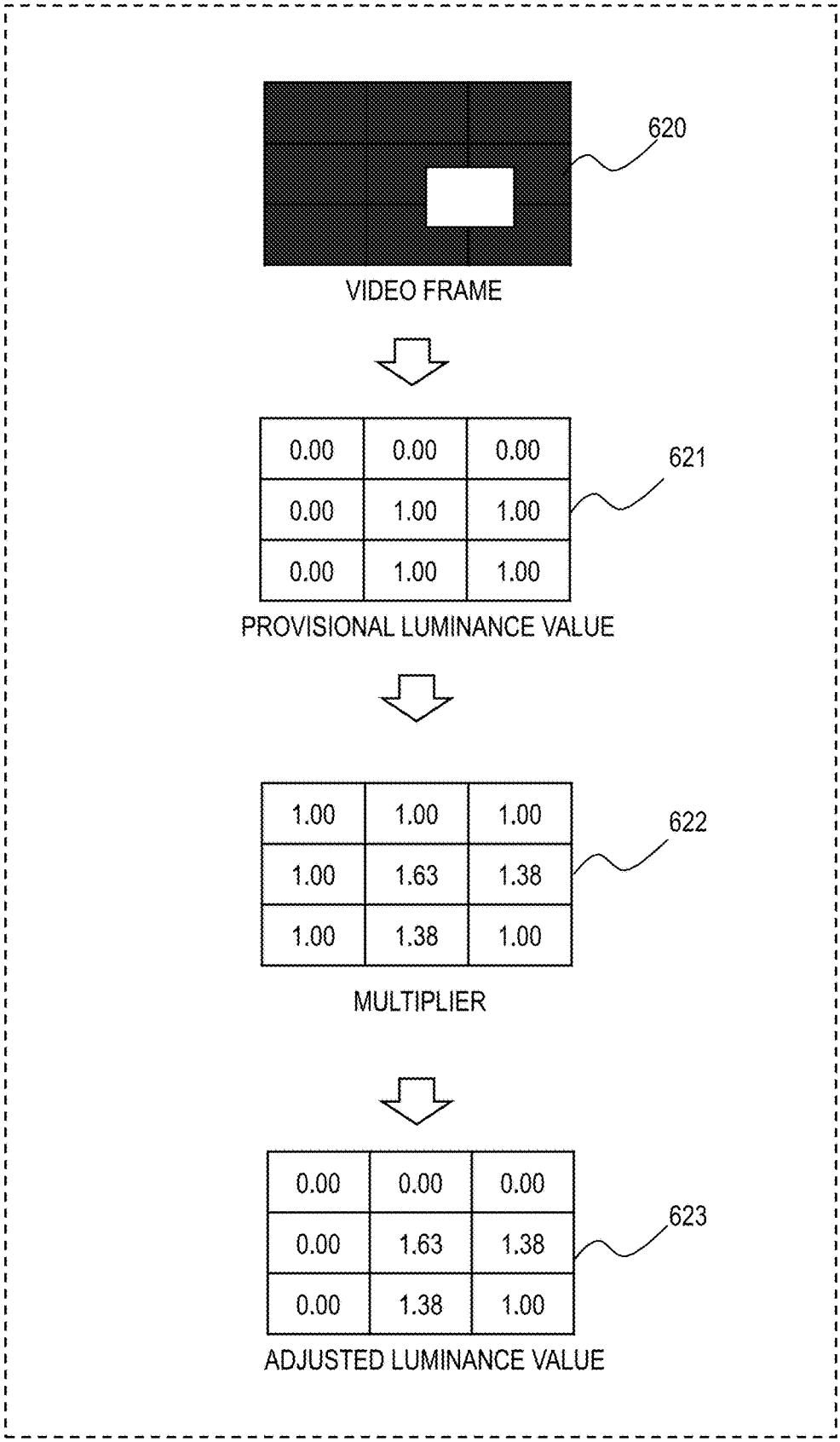
FIG. 13A provides the luminance distribution of another video frame, and a provisional luminance value distribution, a multiplier distribution, and an adjusted luminance value distribution to the backlight blocks obtained from the luminance distribution of the video frame.

FIG. 13A provides a luminance distribution 620 of a video frame, and a provisional luminance value distribution 621, a multiplier distribution 622, and an adjusted luminance value distribution 623 to the backlight blocks obtained from the luminance distribution 620.

The video frame 620 consists of an area where the relative luminance value is 1.0 and its surrounding area where the relative luminance value is 0.0. The area at the relative luminance value of 1.0 faces four lower-right backlight blocks. Accordingly, in the backlight block set, the provisional luminance values for the four lower-right backlight blocks are 1.00 and the provisional luminance values for the other backlight blocks are 0.00. The multipliers as adjustment coefficients for the backlight blocks are as indicated in the multiplier distribution 622. As a result, the adjusted luminance value distribution 623 to the backlight blocks is obtained.

Figure 13B:
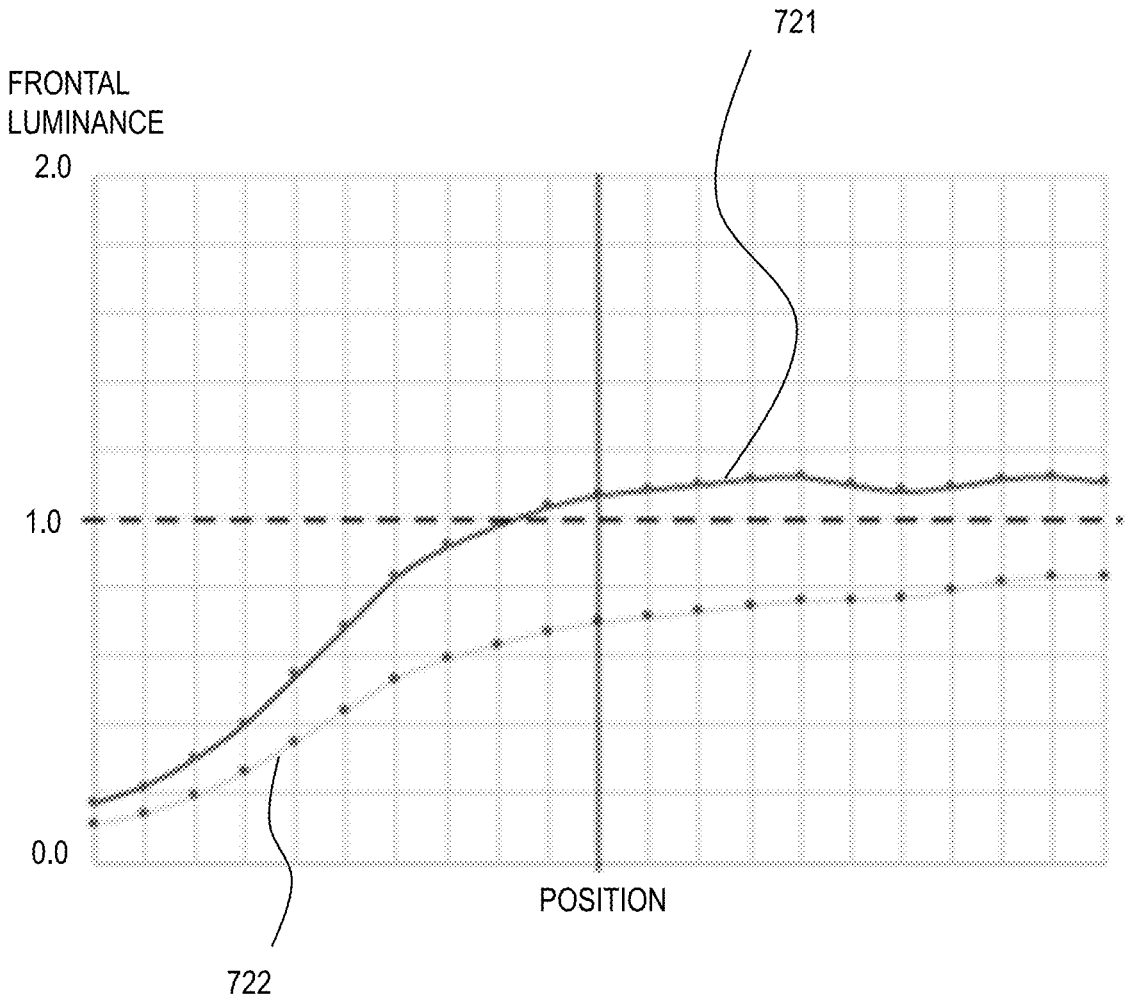
FIG. 13B provides a graph representing the frontal luminance distribution generated by the backlight blocks controlled in accordance with the adjusted luminance value distribution in FIG. 13A.

FIG. 13B provides a graph representing the frontal luminance distribution generated by the backlight blocks controlled in accordance with the adjusted luminance value distribution 623. The line 721 represents the frontal luminance value of the backlight controlled in accordance with the adjusted luminance values and the line 722 represents the frontal luminance value of the backlight controlled in accordance with the provisional luminance values. The backlight controlled in accordance with the adjusted luminance values attains frontal luminance values closer to the desired frontal luminance values.

Figure 14A:
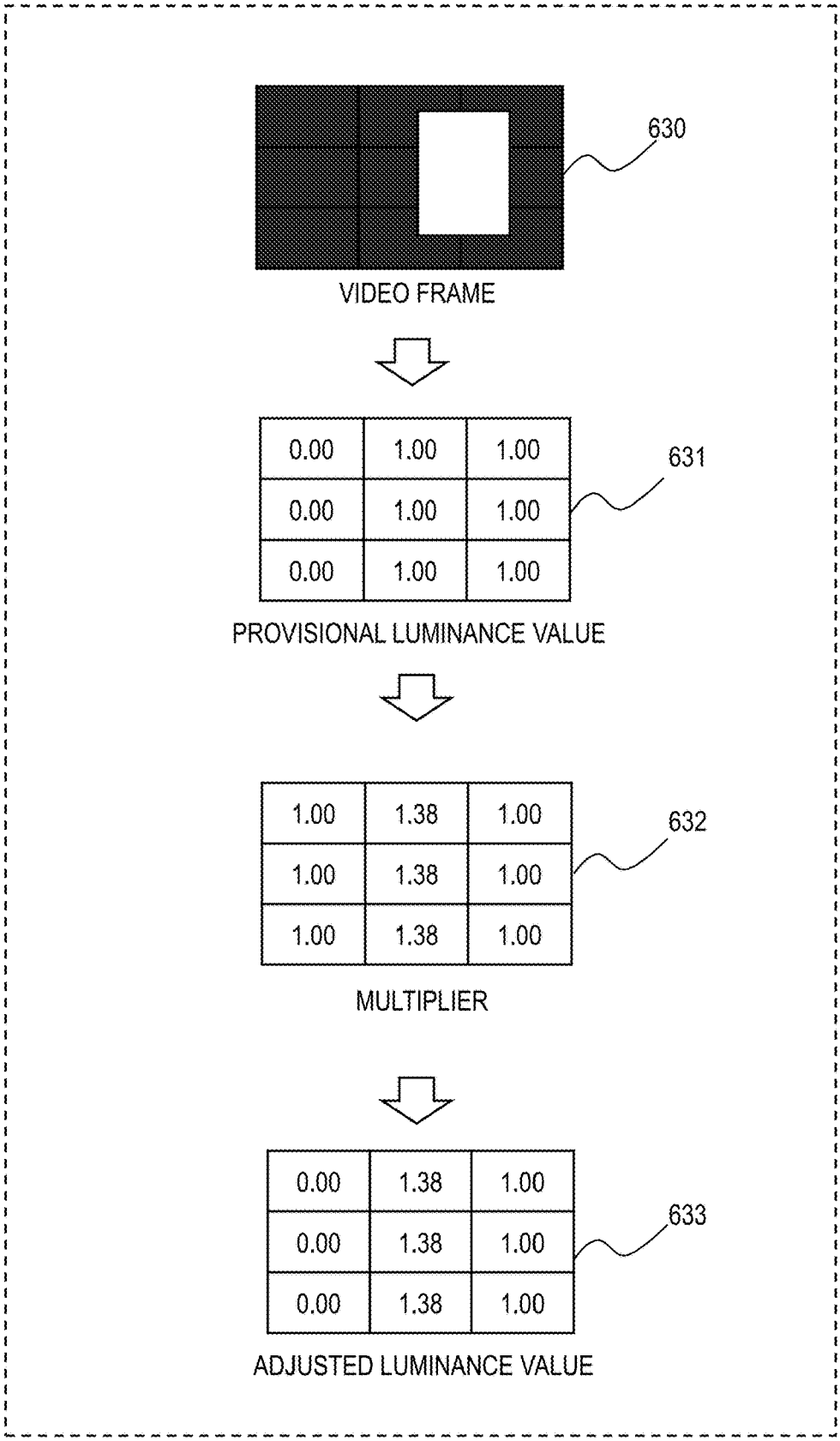
FIG. 14A provides the luminance distribution of still another video frame, and a provisional luminance value distribution, a multiplier distribution, and an adjusted luminance value distribution to the backlight blocks obtained from the luminance distribution of the video frame.

FIG. 14A provides a luminance distribution 630 of a video frame, and a provisional luminance value distribution 631, a multiplier distribution 632, and an adjusted luminance value distribution 633 to the backlight blocks obtained from the luminance distribution 630.

The video frame 630 consists of an area where the relative luminance value is 1.0 and its surrounding area where the relative luminance value is 0.0. The area at the relative luminance value of 1.0 faces six backlight blocks on the right. Accordingly, in the backlight block set, the provisional luminance values for the six backlight blocks on the right are 1.00 and the provisional luminance values for the other backlight blocks are 0.00. The multipliers as adjustment coefficients for the backlight blocks are as indicated in the multiplier distribution 632. As a result, the adjusted luminance value distribution 633 to the backlight blocks is obtained.

Figure 14B:
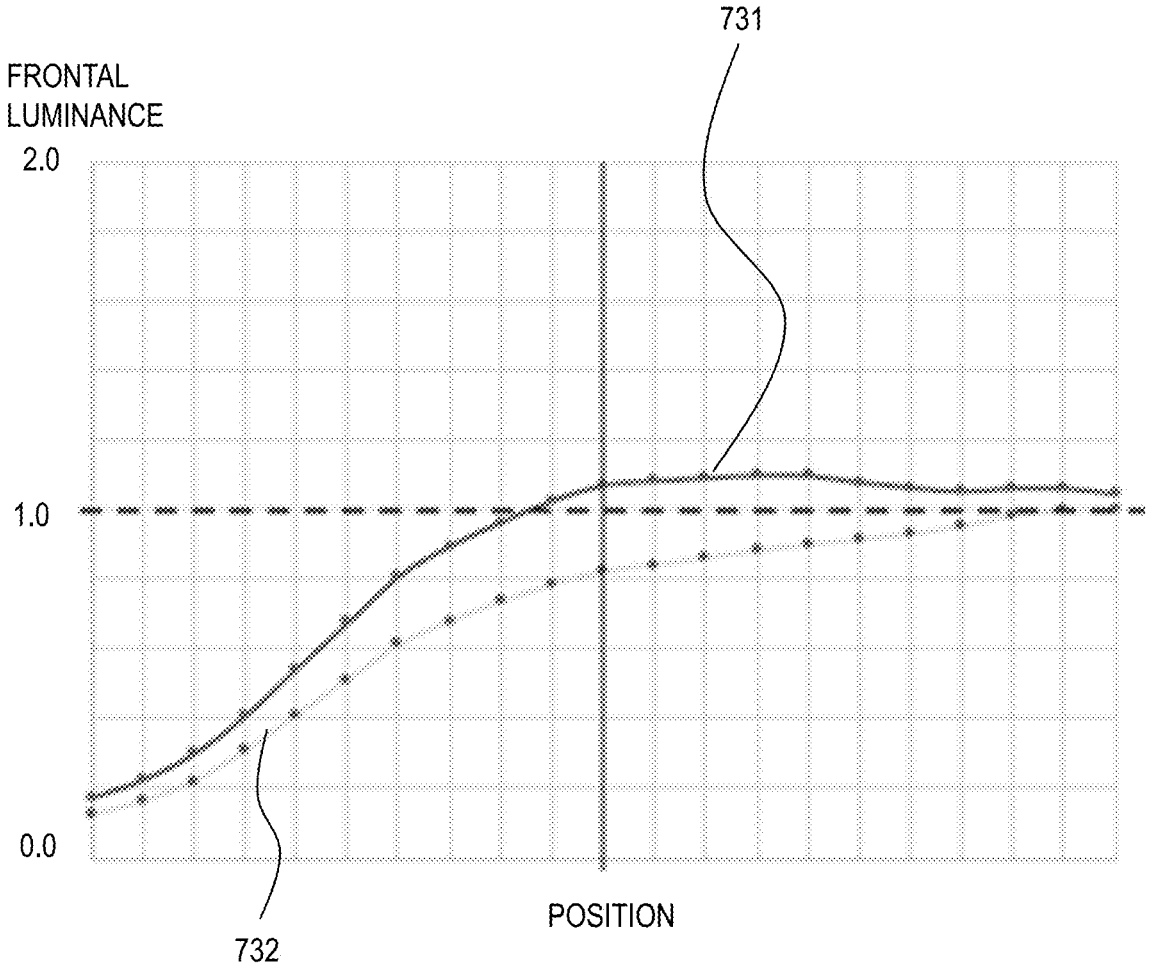
FIG. 14B provides a graph representing the frontal luminance distribution generated by the backlight blocks controlled in accordance with the adjusted luminance value distribution in FIG. 14A.

FIG. 14B provides a graph representing the frontal luminance distribution generated by the backlight blocks controlled in accordance with the adjusted luminance value distribution 633. The line 731 represents the frontal luminance value of the backlight controlled in accordance with the adjusted luminance values and the line 732 represents the frontal luminance value of the backlight controlled in accordance with the provisional luminance values. The backlight controlled in accordance with the adjusted luminance values attains frontal luminance values closer to the desired frontal luminance values.

Figure 15A:
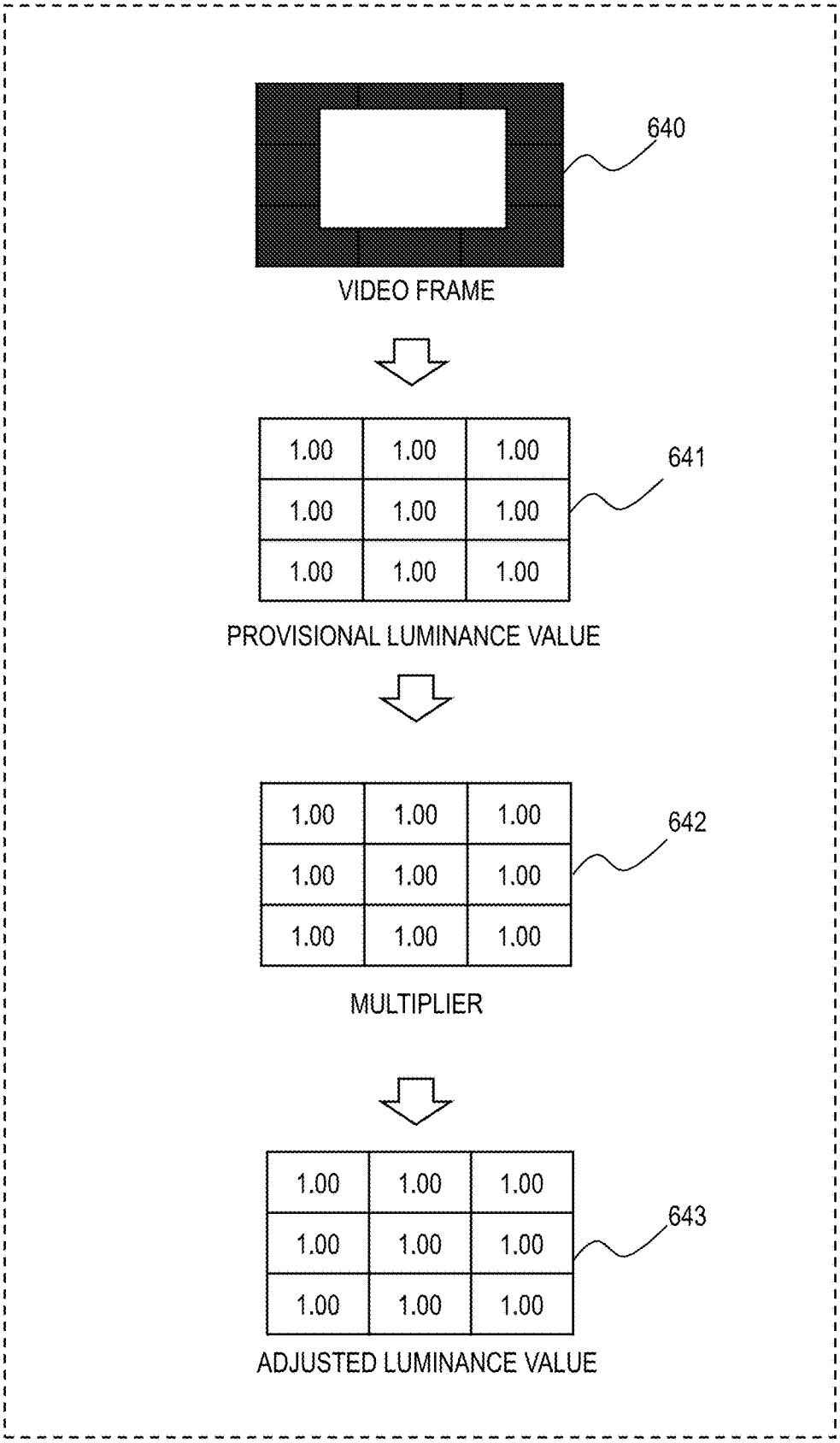
FIG. 15A provides the luminance distribution of still another video frame, and a provisional luminance value distribution, a multiplier distribution, and an adjusted luminance value distribution to the backlight blocks obtained from the luminance distribution of the video frame.

FIG. 15A provides a luminance distribution 640 of a video frame, and a provisional luminance value distribution 641, a multiplier distribution 642, and an adjusted luminance value distribution 643 to the backlight blocks obtained from the luminance distribution 640.

The video frame 640 consists of an area where the relative luminance value is 1.0 and its surrounding area where the relative luminance value is 0.0. The area at the relative luminance value of 1.0 faces all the nine backlight blocks. Accordingly, in the backlight block set, the provisional luminance values for all backlight blocks are 1.00. The multipliers as adjustment coefficients for the backlight blocks are as indicated in the multiplier distribution 642. As a result, the adjusted luminance value distribution 643 to the backlight blocks is obtained.

Figure 15B:
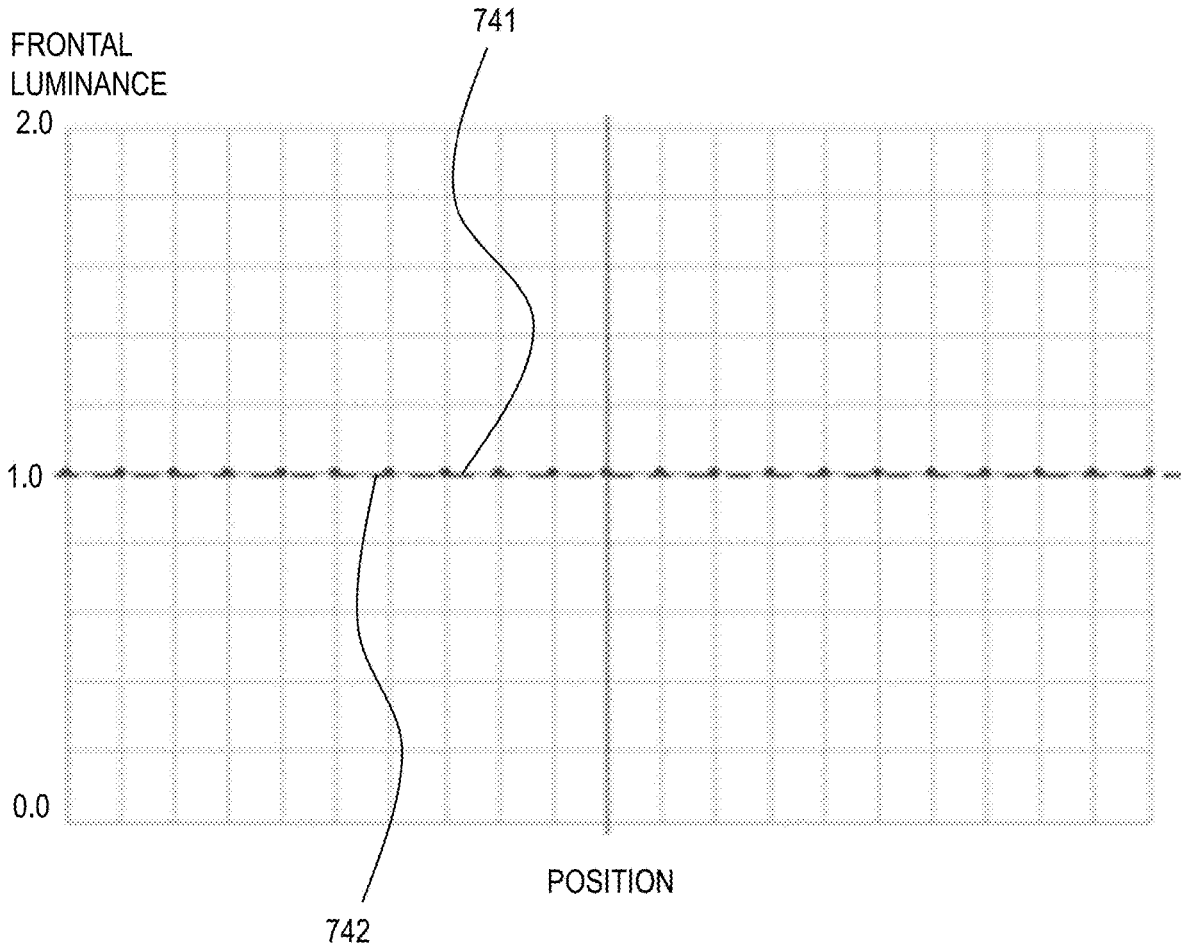
FIG. 15B provides a graph representing the frontal luminance distribution generated by the backlight blocks controlled in accordance with the adjusted luminance value distribution in FIG. 15A.

FIG. 15B provides a graph representing the frontal luminance distribution generated by the backlight blocks controlled in accordance with the adjusted luminance value distribution 643. The line 741 represents the frontal luminance value of the backlight controlled in accordance with the adjusted luminance values and the line 742 represents the frontal luminance value of the backlight controlled in accordance with the provisional luminance values. The backlight controlled in accordance with the adjusted luminance values attains desired frontal luminance values.

Figure 16A:
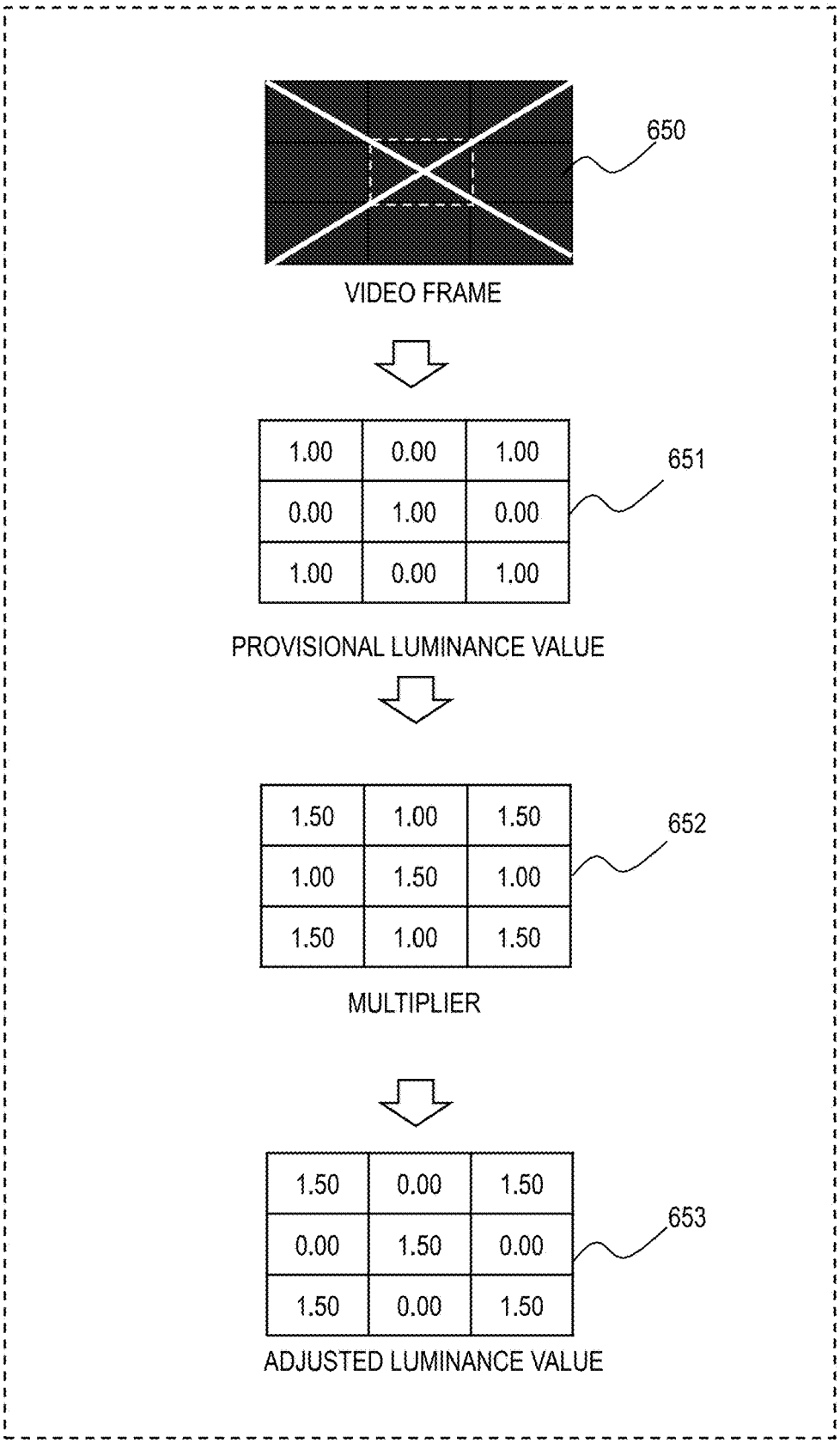
FIG. 16A provides the luminance distribution of still another video frame, and a provisional luminance value distribution, a multiplier distribution, and an adjusted luminance value distribution to the backlight blocks obtained from the luminance distribution of the video frame.

FIG. 16A provides a luminance distribution 650 of a video frame, and a provisional luminance value distribution 651, a multiplier distribution 652, and an adjusted luminance value distribution 653 to the backlight blocks obtained from the luminance distribution 650.

In the video frame 650, the relative luminance values of two straight lines crossing each other are 1.0 and the relative luminance value of their surrounding area is 0.0. The two straight lines face five backlight blocks of the backlight blocks at the four corners and the central backlight block. Accordingly, in the backlight block set, the provisional luminance values for these five backlight blocks are 1.00 and the provisional luminance values for the other backlight blocks are 0.00. The multipliers as adjustment coefficients for the backlight blocks are as indicated in the multiplier distribution 652. As a result, the adjusted luminance value distribution 653 to the backlight blocks is obtained.

Figure 16B:
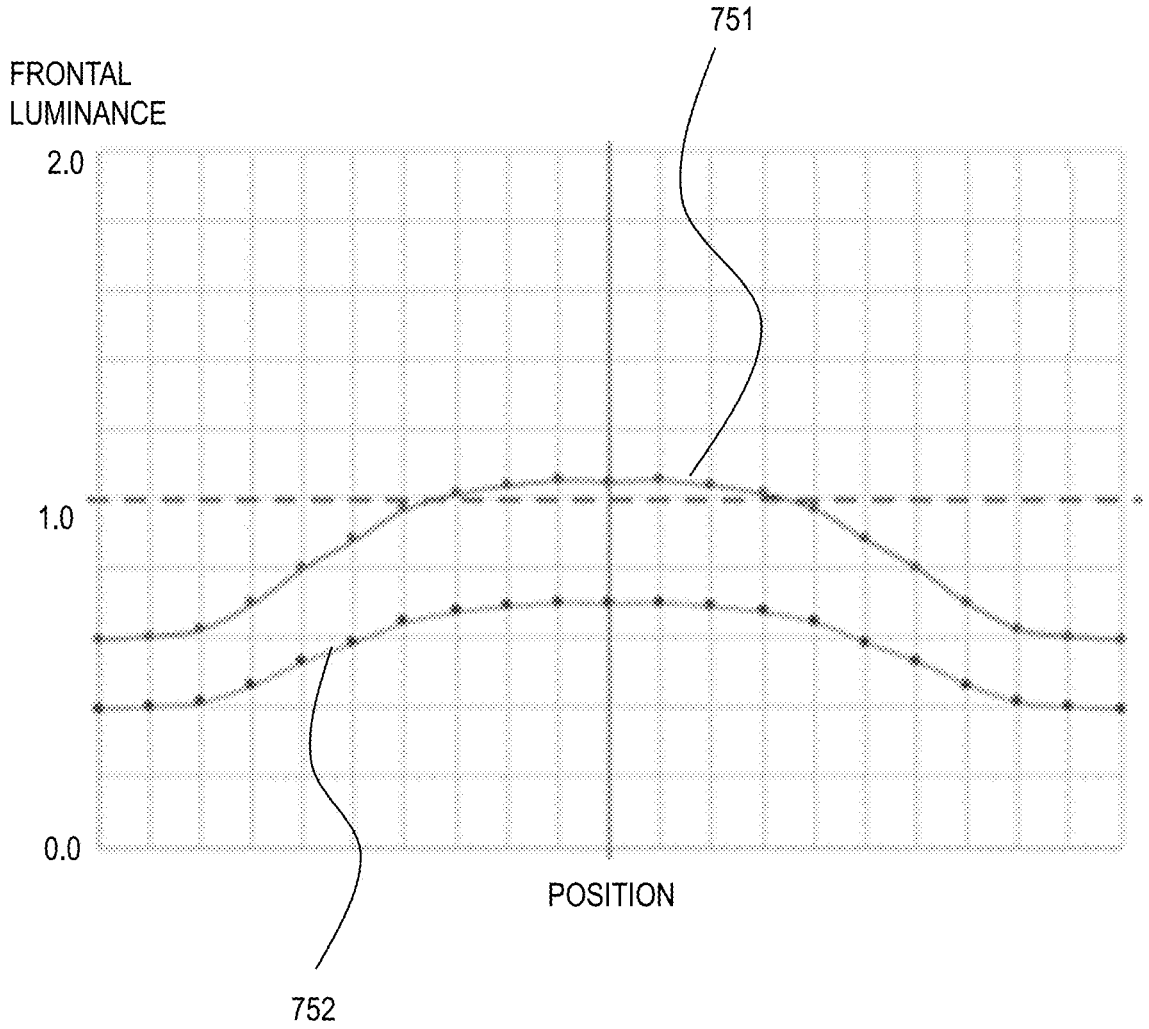
FIG. 16B provides a graph representing the frontal luminance distribution generated by the backlight blocks controlled in accordance with the adjusted luminance value distribution in FIG. 16A.

FIG. 16B provides a graph representing the frontal luminance distribution generated by the backlight blocks controlled in accordance with the adjusted luminance value distribution 653. The line 751 represents the frontal luminance value of the backlight controlled in accordance with the adjusted luminance values and the line 752 represents the frontal luminance value of the backlight controlled in accordance with the provisional luminance values. The backlight controlled in accordance with the adjusted luminance values attains frontal luminance values closer to the desired frontal luminance values.

Figure 17A:
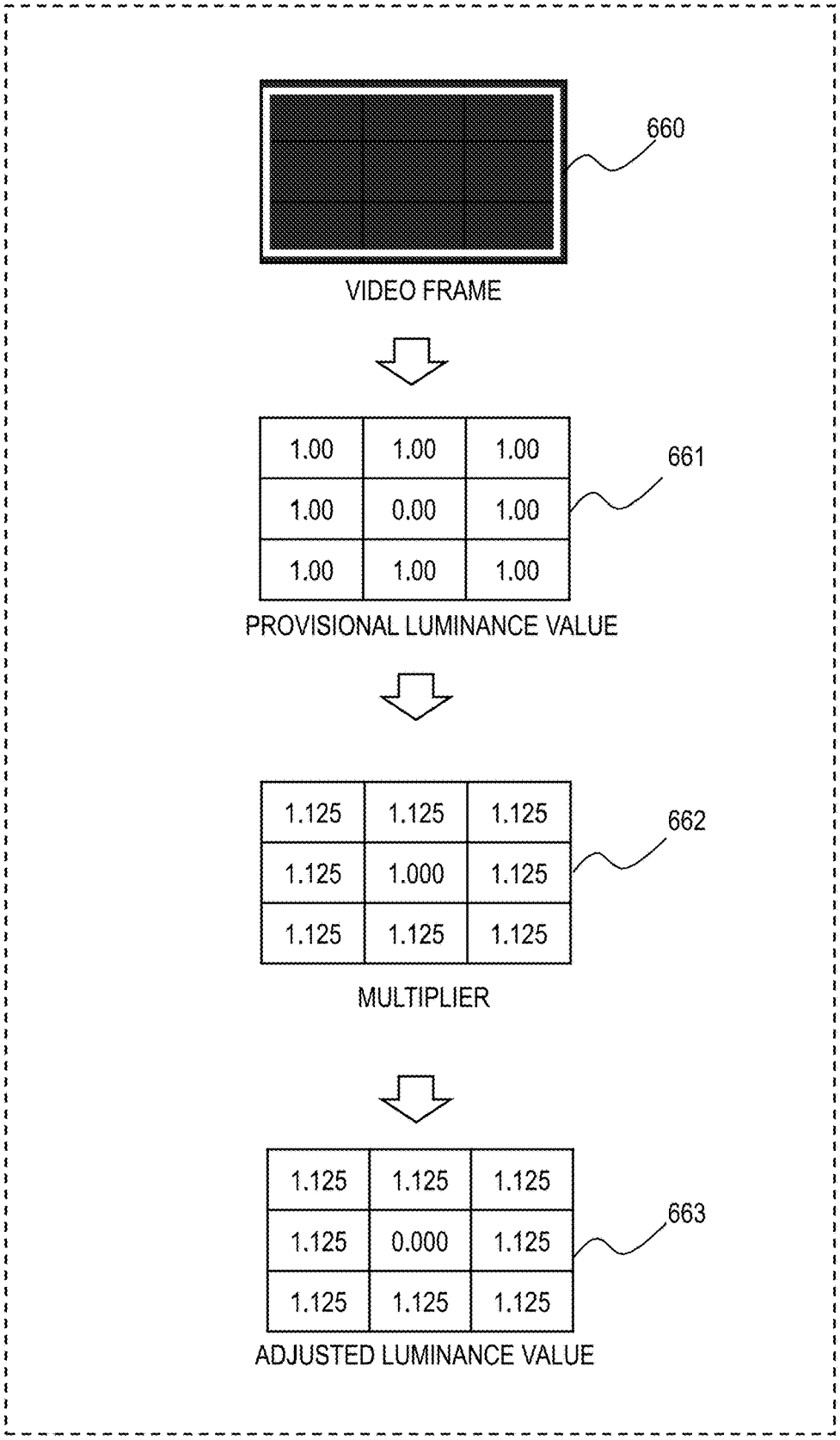
FIG. 17A provides the luminance distribution of still another video frame, and a provisional luminance value distribution, a multiplier distribution, and an adjusted luminance value distribution to the backlight blocks obtained from the luminance distribution of the video frame.

FIG. 17A provides a luminance distribution 660 of a video frame, and a provisional luminance value distribution 661, a multiplier distribution 662, and an adjusted luminance value distribution 663 to the backlight blocks obtained from the luminance distribution 660.

In the video frame 660, the relative luminance value of a rectangular frame close to the outer end is 1.0 and the relative luminance value of the other area is 0.0. The rectangular frame faces eight backlight blocks except for the central backlight block. Accordingly, in the backlight block set, the provisional luminance values for the aforementioned eight backlight blocks are 1.00 and the provisional luminance value for the central backlight block is 0.00. The multipliers as adjustment coefficients for the backlight blocks are as indicated in the multiplier distribution 662. As a result, the adjusted luminance value distribution 663 to the backlight blocks is obtained.

Figure 17B:
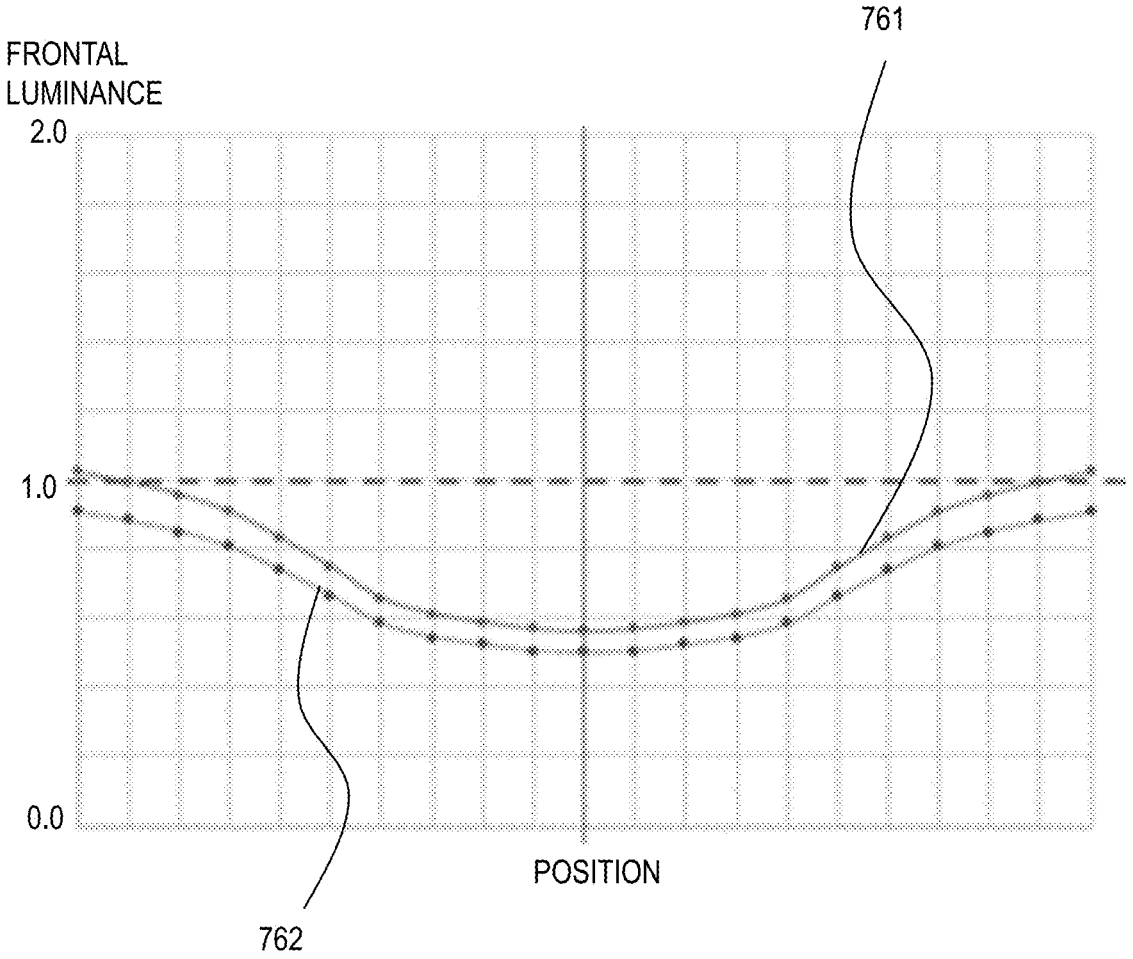
FIG. 17B provides a graph representing the frontal luminance distribution generated by the backlight blocks controlled in accordance with the adjusted luminance value distribution in FIG. 17A.

FIG. 17B provides a graph representing the frontal luminance distribution generated by the backlight blocks controlled in accordance with the adjusted luminance value distribution 663. The line 761 represents the frontal luminance value of the backlight controlled in accordance with the adjusted luminance values and the line 762 represents the frontal luminance value of the backlight controlled in accordance with the provisional luminance values. The backlight controlled in accordance with the adjusted luminance values attains frontal luminance values closer to the desired frontal luminance values.

Third Embodiment

Another embodiment of this specification is described. The following mainly describes differences from the first embodiment. The adjustment coefficient calculator 213 calculates the adjustment coefficient MULT_COEF using the following method when predetermined conditions are satisfied:

$$MULT_COEF=K+LUMI_SELF\times(1-K),$$

where K is a given coefficient ($0\leq K<1$).

The predetermined conditions are the following two conditions:

Condition 1: The provisional luminance values for all adjacent blocks are 1 (AVE_ADJ=1); and Condition 2: LUMI_SELF<1.

If all blocks adjacent to the backlight block of interest are lit (Condition 1) and the backlight block of interest is lit at a luminance value lower than the maximum value (Condition 2), the backlight block of interest receives light leaking from the adjacent backlight blocks without exception. For this reason, the contrast ratio of the backlight block of interest to the adjacent backlight blocks becomes low. This embodiment lowers the luminance of the backlight block of interest by the amount of contribution of the light leaking from the adjacent backlight blocks. This configuration restrains degradation of image quality and further, saves the power for the backlight block of interest.

Figure 18:
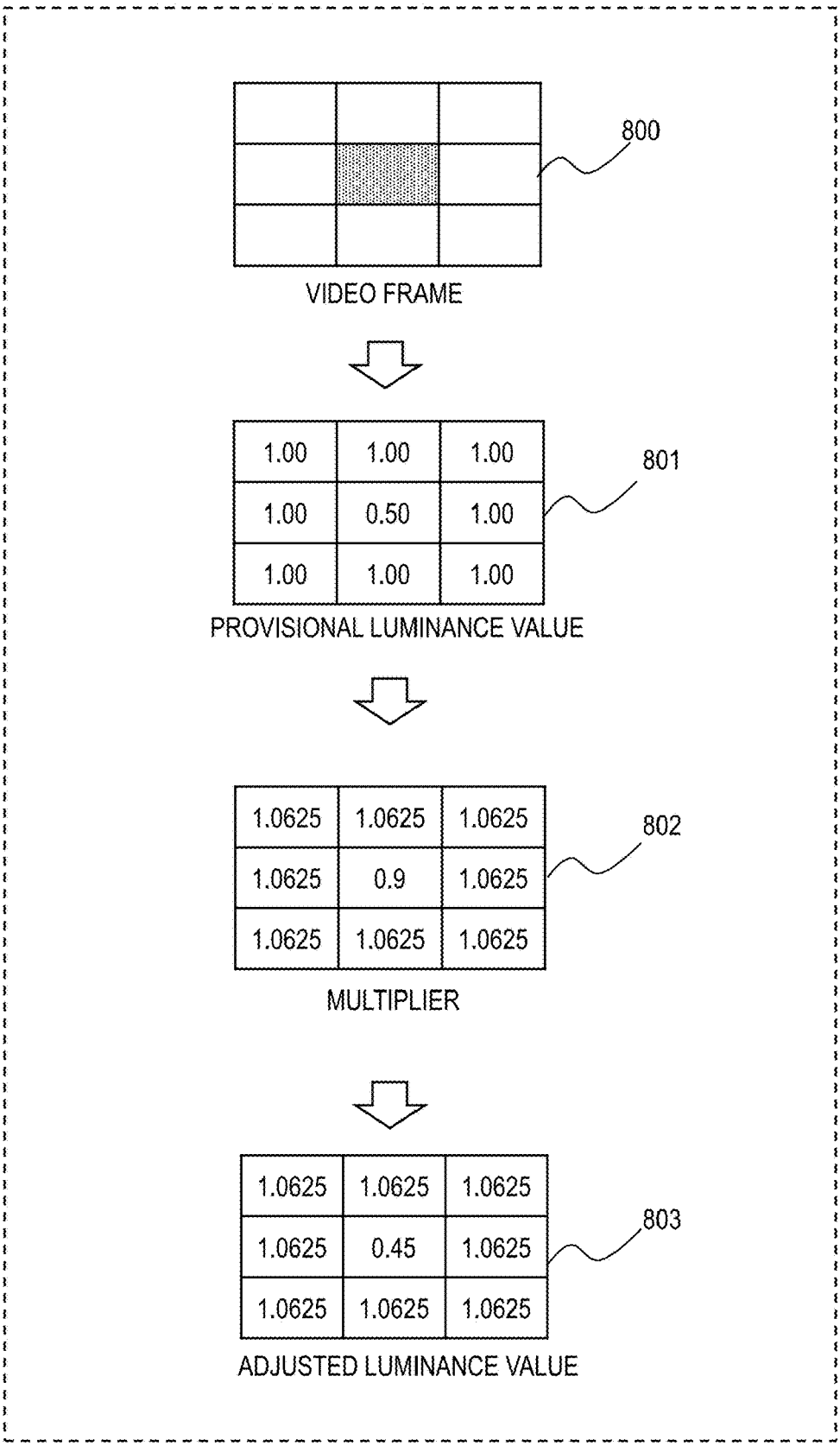
FIG. 18 provides the luminance distribution of still another video frame, and a provisional luminance value distribution, a multiplier distribution, and an adjusted luminance value distribution to the backlight blocks obtained from the luminance distribution of the video frame in an embodiment of this specification.

FIG. 18 provides a luminance distribution 800 of a video frame, and a provisional luminance value distribution 801, a multiplier distribution 802, and an adjusted luminance value distribution 803 to the backlight blocks obtained from the luminance distribution 800. The video frame 800 consists of a sub-region located at the center where the relative luminance value is 0.5 and its surrounding sub-regions where the relative luminance value is 1.0. Each sub-region is opposite to a different backlight block.

The provisional luminance value for the central backlight block is 0.5 and the provisional luminance values for the other backlight blocks are 1.0. The multipliers as adjustment coefficients for the backlight blocks are as indicated in the multiplier distribution 802. As a result, the adjusted luminance value distribution 803 to the backlight blocks is obtained.

The multipliers (adjustment coefficients) are calculated as follows. The multiplier for the central backlight block is calculated using the following formula in this embodiment:

$$MULT_COEF=K+LUMI_SELF\times(1-K),$$

where K is a value greater than 0 and smaller than 1. In this example, the coefficient K is 0.8.

The multipliers for the surrounding backlight blocks are calculated using the following formula in the first embodiment:

$$MULT_COEF=A-(A-1)*LUMI_COEF,$$

where the coefficient A is 2.

In the example illustrated in FIG. 18, the central backlight block receives light leaking from its adjacent backlight blocks in the actual luminance distribution including the leakage light. Accordingly, a luminance value higher than the primary target feature value of 0.5 is attained. Using a multiplier (adjustment coefficient) smaller than 1 attains the target feature value. In determining the value for the coefficient K to calculate the multiplier (adjustment coefficient), the adjustment coefficient calculator 213 calculates the amount of light leaking from the adjacent backlight blocks in advance and determines a value for the coefficient K so that the result of adding the luminescence calculated with the multiplier and the leakage from the adjacent backlight blocks will become higher than the calculated feature value of the backlight block. The adjustment coefficient smaller than 1 can be determined by a different method. The adjustment coefficient calculator 213 determines such an adjustment coefficient based on the relation between the provisional luminance value for the backlight block of interest and the statistic of the provisional luminance values for the reference backlight blocks.

As described with reference to FIG. 10, this embodiment can also exclude the backlight blocks diagonally adjacent to the backlight block of interest from the reference backlight blocks. In other words, the reference backlight blocks can consist of horizontally adjacent backlight blocks and vertically adjacent backlight blocks. The method of calculating the adjustment coefficient can be the same as illustrated in FIG. 18, except that some of the reference backlight blocks are excluded.

Figure 19:
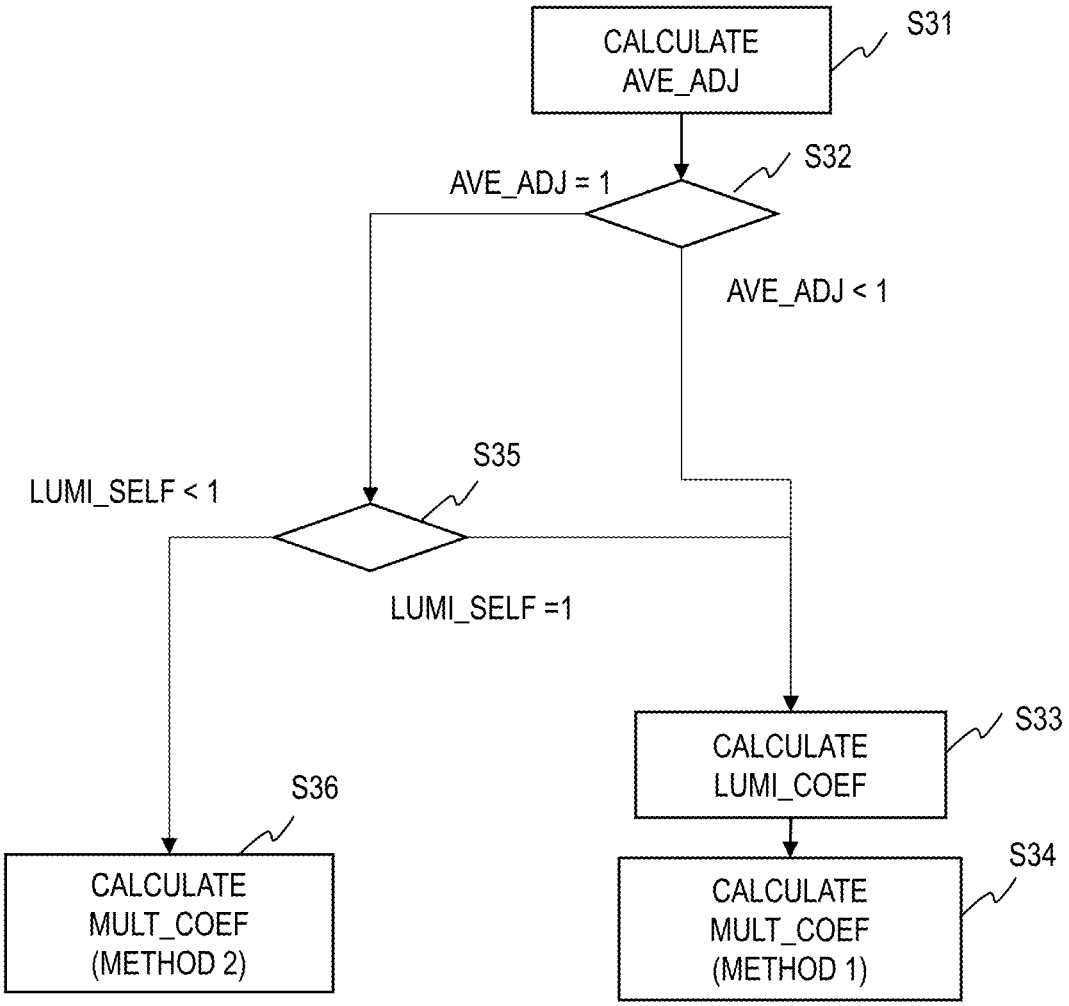
FIG. 19 is a flowchart of an example of the processing of an adjustment coefficient calculator.

FIG. 19 is a flowchart of an example of the processing of the adjustment coefficient calculator 213. The adjustment coefficient calculator 213 calculates the statistic AVE_ADJ of the provisional luminance values for the reference backlight blocks (S31) as described in the first embodiment and makes determination on the value (S32). If the value of AVE_ADJ is smaller than 1 (S32: AVE_ADJ<1), the adjustment coefficient calculator 213 calculates the relative value LUMI_COEF of the statistic AVE_ADJ with respect to the provisional luminance value LUMI_SELF for the backlight block of interest 300 (S33) as described in the first embodiment. Further, the adjustment coefficient calculator 213 calculates the adjustment coefficient MULT_COEF (S34) as described in the first embodiment.

If the determination at Step S32 is that the value of AVE_ADJ is 1 (S32: AVE_ADJ=1), the adjustment coefficient calculator 213 determines whether the provisional luminance value LUMI_SELF for the backlight block of interest 300 is 1 (S35). If the provisional luminance value LUMI_SELF for the backlight block of interest 300 is 1, the adjustment coefficient calculator 213 proceeds to Step S33. If the provisional luminance value LUMI_SELF for the backlight block of interest 300 is smaller than 1, the adjustment coefficient calculator 213 calculates the adjustment coefficient MULT_COEF by the method of this embodiment (S36).

Fourth Embodiment

Figure 20:
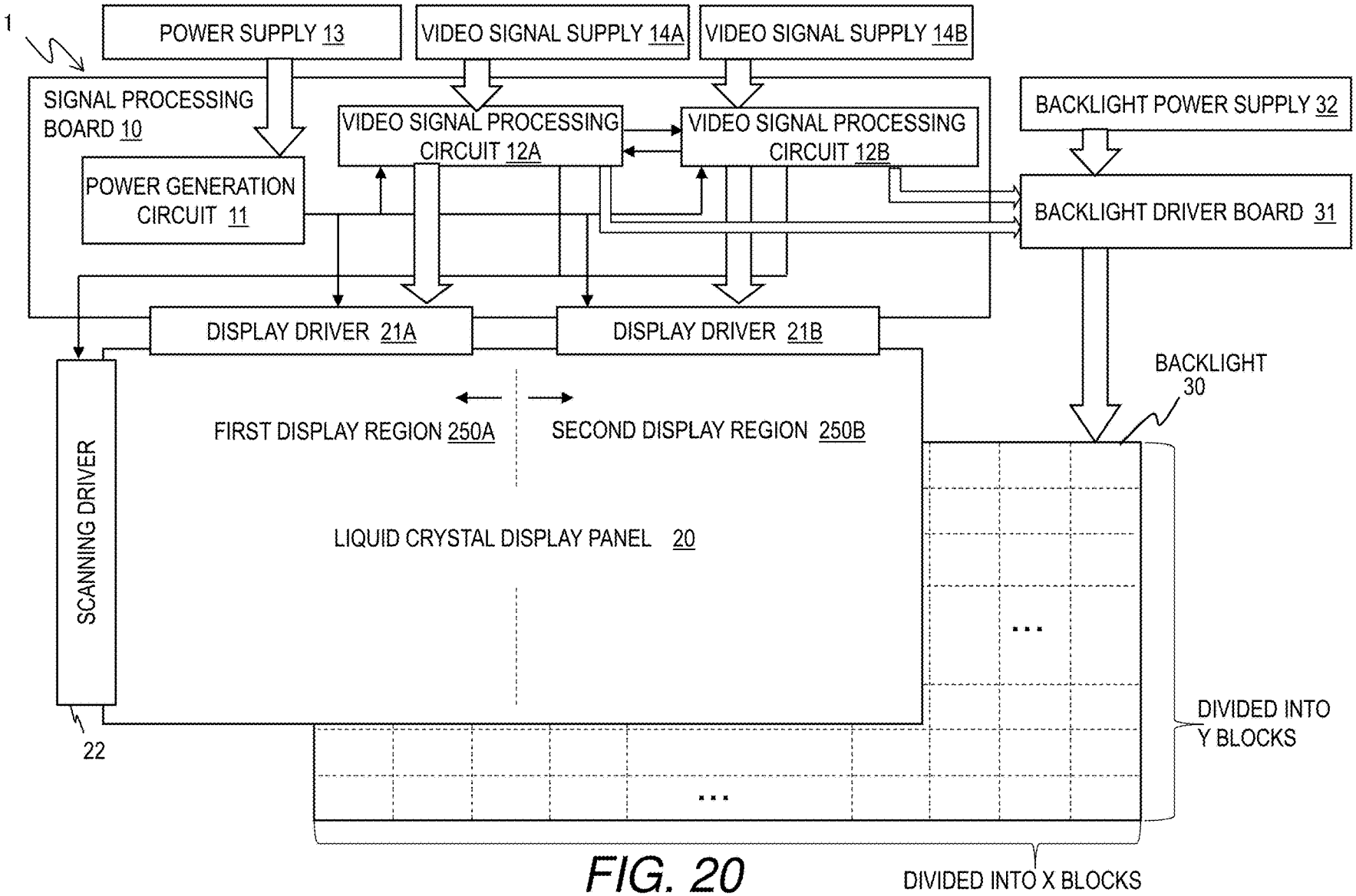
FIG. 20 illustrates a configuration example of a display device in another embodiment of this specification.

FIG. 20 illustrates a configuration example of a display device in another embodiment of this specification. The following mainly describes differences from the configuration example in FIG. 1. The liquid crystal display device 1 includes video signal supplies 14A and 14B and display drivers 21A and 21B. The signal processing board 10 includes video signal processing circuits 12A and 12B. The video signal processing circuit 12A is a first processing circuit and the video signal processing circuit 12B is a second processing circuit. This configuration can be employed when the display region is divided horizontally or vertically to be driven by different ICs because the display region has a resolution too high to be driven by one IC.

The liquid crystal display panel 20 includes a first display region 250A and a second display region 250B adjoining each other. The video signal processing circuit 12A performs processing involved in displaying a picture, such as generating a signal for displaying an image in the first display region 250A and a signal for controlling the backlight 30. The video signal processing circuit 12B performs processing involved in displaying a picture, such as generating a signal for displaying an image in the second display region 250B and a signal for controlling the backlight 30. The video signal supply 14A supplies a video signal to the video signal processing circuit 12A and the video signal supply 14B supplies a video signal to the video signal processing circuit 12B.

The display driver 21A generates a data signal from the video signal sent from the video signal processing circuit 12A and supplies the data signal to the first display region 250A. The display driver 21B generates a data signal from the video signal sent from the video signal processing circuit 12B and supplies the data signal to the second display region 250B. The video signal processing circuit 12A also sends a timing signal to the display driver 21A and the display driver 21A generates a data signal from the received video signal and supplies the data signal to the first display region 250A in accordance with the timing signal. The video signal processing circuit 12B also sends a timing signal to the display driver 21B. The display driver 21B generates a data signal from the received video signal and supplies the data signal to the second display region 250B in accordance with the timing signal.

The video signal processing circuit 12A converts the data arrangement of the video signal input from the external to send it to the display driver 21A and generates and sends a timing signal for the display driver 21A and the scanning driver 22 to operate using the power supplied from the power generation circuit 11. The video signal processing circuit 12A further generates a driving control signal for controlling the driving of the backlight 30 and sends it to the backlight driver board 31.

The video signal processing circuit 12B converts the data arrangement of the video signal input from the external to send it to the display driver 21B and generates and sends a timing signal for the display driver 21B and the scanning driver 22 to operate using the power supplied from the power generation circuit 11. The video signal processing circuit 12B further generates a driving control signal for controlling the driving of the backlight 30 and sends it to the backlight driver board 31.

The backlight driver board 31 includes a backlight driver circuit and controls the lighting (luminance) of the backlight 30 in accordance with the driving control signals sent from the video signal processing circuits 12A and 12B.

Each of the video signal processing circuits 12A and 12B generates a driving control signal for controlling the luminance of individual blocks of the backlight 30 and sends the driving control signal to the backlight driver board 31. The backlight driver board 31 drives and controls the light sources of the backlight 30 so that the individual blocks light at the luminance values specified in the driving control signals from the video signal processing circuits 12A and 12B.

The video signal processing circuit 12A generates a timing signal for the display driver 21A and the scanning driver 22 in accordance with the input timing signal for the video signal and also, successively sends a signal (frame signal) of each video frame in the video signal to the display driver 21A. The video signal processing circuit 12B generates a timing signal for the display driver 21B and the scanning driver 22 in accordance with the input timing signal for the video signal and also, successively sends a signal (frame signal) of each video frame in the video signal to the display driver 21B.

The video signal processing circuit 12A analyzes the video frame, generates a driving control signal for the backlight 30 to illuminate the first display region 250A from its behind based on the analysis result, and sends the driving control signal to the backlight 30. The video signal processing circuit 12B analyzes the video frame, generates a driving control signal for the backlight 30 to illuminate the second display region 250B from its behind based on the analysis result, and sends the driving control signal to the backlight 30.

Figure 21:
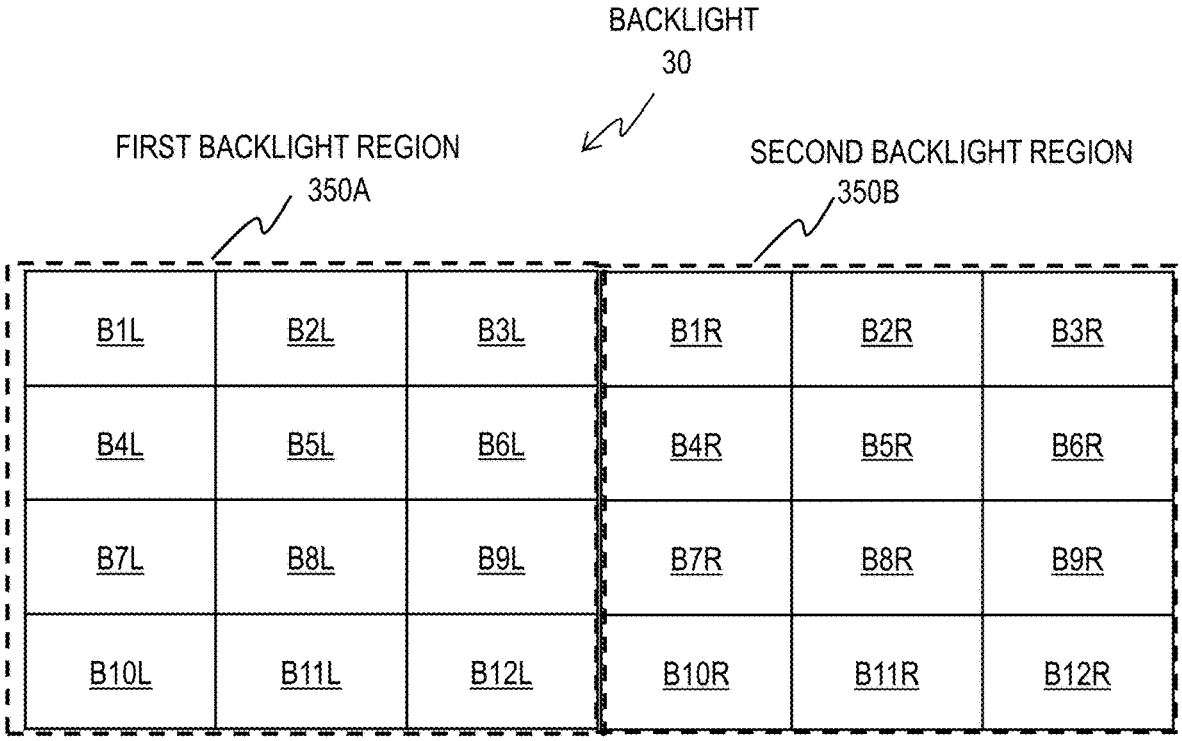
FIG. 21 schematically illustrates a configuration of a backlight.

FIG. 21 schematically illustrates the configuration of the backlight 30. The backlight 30 consists of a first backlight region 350A on the left and a second backlight region 350B on the right. The first backlight region 350A is directly beneath the first display region 250A. The first backlight region 350A is located behind and opposite to the first display region 250A to illuminate the first display region 250A. The second backlight region 350B is directly beneath the second display region 250B. The second backlight region 350B is located behind and opposite to the second display region 250B to illuminate the second display region 250B.

The first backlight region 350A consists of twelve backlight blocks B1L to B12L (the first backlight block group). Although a case of twelve backlight blocks is described here, the number of backlight blocks is not limited to twelve; the first backlight region 350A can consist of N×M blocks (N and M are natural numbers). The second backlight region 350B consists of twelve backlight blocks B1R to B12R (the second backlight block group). The backlight blocks B3L, B6L, B9L, and B12L adjoin the second backlight region 350B. The backlight blocks B1R, B4R, B7R, and B10R adjoin the first backlight region 350A.

The video signal processing circuit 12A sends the video signal processing circuit 12B information on provisional luminance values for the first backlight region 350A. The video signal processing circuit 12B determines adjustment coefficients for the second backlight region 350B based on the provisional luminance values for the second backlight region 350B and the provisional luminance values for the first backlight region 350A received from the video signal processing circuit 12A.

The video signal processing circuit 12B sends the video signal processing circuit 12A information on provisional luminance values for the second backlight region 350B. The video signal processing circuit 12A determines adjustment coefficients for the first backlight region 350A based on the provisional luminance values for the first backlight region 350A and the provisional luminance values for the second backlight region 350B received from the video signal processing circuit 12B.

Figure 22:
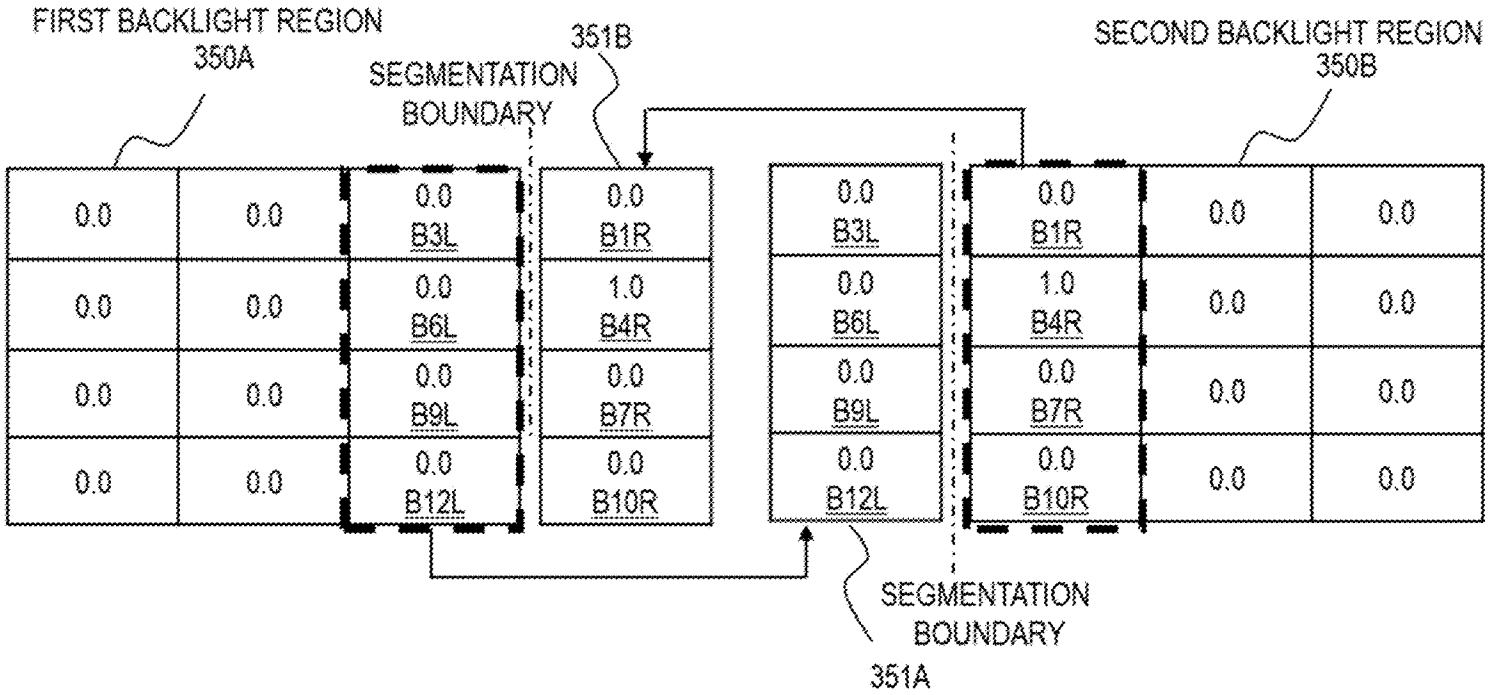
FIG. 22 illustrates an example of information on provisional luminance values communicated between video signal processing circuits.

FIG. 22 illustrates an example of the information on provisional luminance values communicated between the video signal processing circuits 12A and 12B. The video signal processing circuit 12A sends the video signal processing circuit 12B information on the provisional luminance values for the backlight block set 351A in the first backlight region 350A that is adjoining the second backlight region 350B. The backlight block set 351A consists of the backlight blocks B3L, B6L, B9L, and B12L.

The video signal processing circuit 12B sends the video signal processing circuit 12A information on the provisional luminance values for the backlight block set 351B in the second backlight region 350B that is adjoining the first backlight region 350A. The backlight block set 351B consists of the backlight blocks B1R, B4R, B7R, and B10R.

The video signal processing circuit 12A refers to the information on the provisional luminance values for the backlight block set 351B received from the video signal processing circuit 12B in calculating the adjustment coefficients for the backlight block set 351A. In similar, the video signal processing circuit 12B refers to the information on the provisional luminance values for the backlight block set 351A received from the video signal processing circuit 12A in calculating the adjustment coefficients for the backlight block set 351B. The method of determining each adjustment coefficient can be the same as described in the first embodiment.

Each of the video signal processing circuits 12A and 12B sends the other video signal processing circuit the provisional luminance values for the backlight blocks that are assigned to itself and adjacent to the backlight blocks controlled by the other video signal processing circuit, so that the backlight blocks located in the border between backlight regions can be provided with more appropriate adjustment coefficients.

Figure 23:
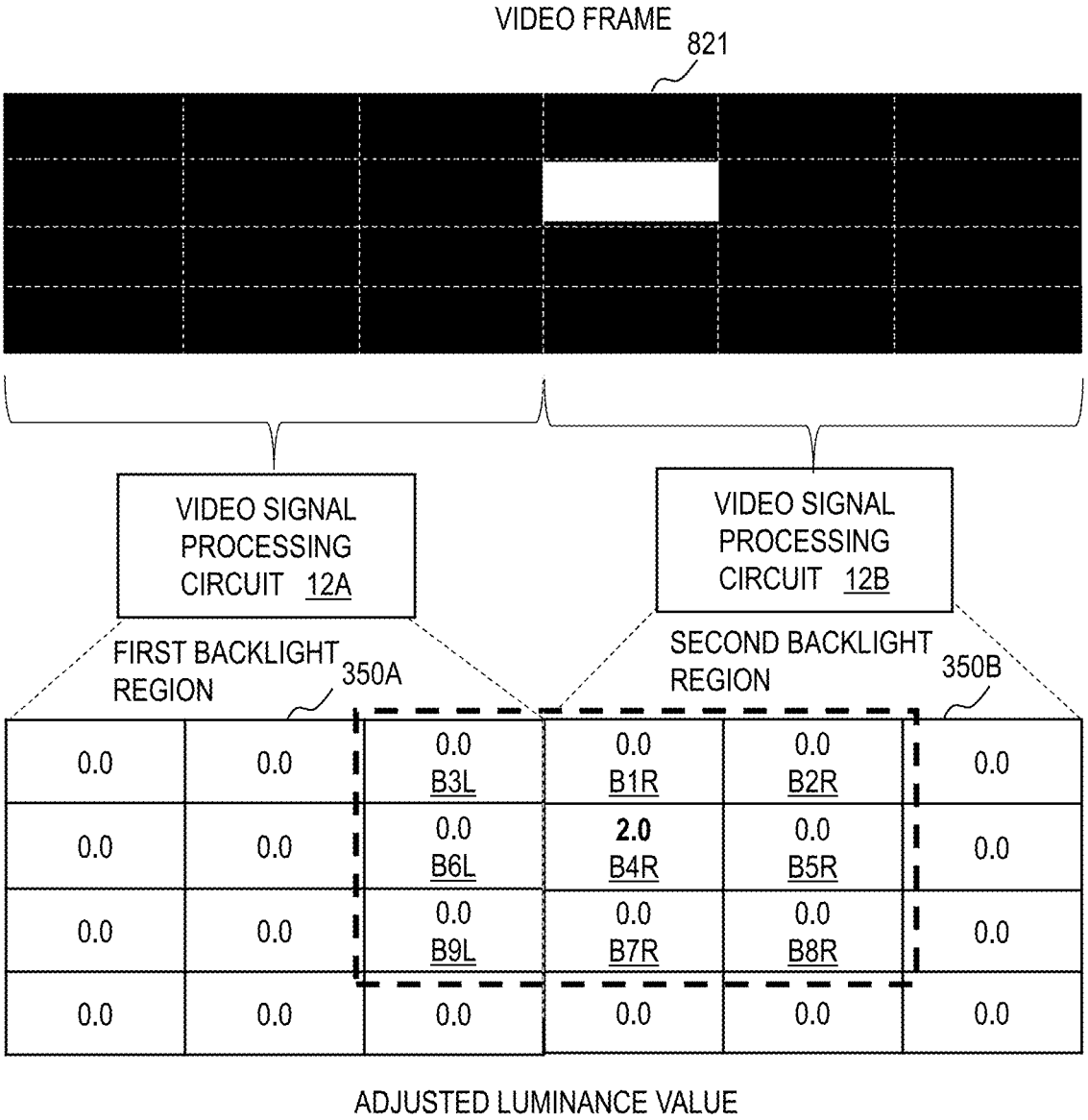
FIG. 23 illustrates an example of the relation between a video frame and adjusted luminance values for the corresponding backlight blocks.

FIG. 23 illustrates an example of the relation between a video frame and adjusted luminance values for the corresponding backlight blocks. In the video frame 821, only the region opposite to one backlight block is white and the other regions are black. The video signal processing circuit 12A controls only the first backlight region 350A and the video signal processing circuit 12B controls only the second backlight region 350B.

As described above, in the case where a backlight block of interest is adjoining the segmentation boundary of the backlight 30, each video signal processing circuit sends information on the provisional luminance values for the backlight blocks adjoining the boundary to the other video processing circuit to complement necessary information.

In FIG. 23, only the region of the video frame corresponding to the backlight block B4R is white and the other regions are black. The video signal processing circuit 12B refers to not only the provisional luminance values for the backlight blocks B1R, B2R, B5R, and B7R in the second backlight region 350B but also the provisional luminance values for the backlight blocks B3L, B6L, and B9L in the first backlight region 350A to determine the adjustment coefficient for the backlight block B4R. The calculation method of the adjustment coefficient can be the same as described in the first embodiment. As a result, the backlight block B4R can be provided with an appropriate adjusted luminance value of 2.0.

Figure 24:
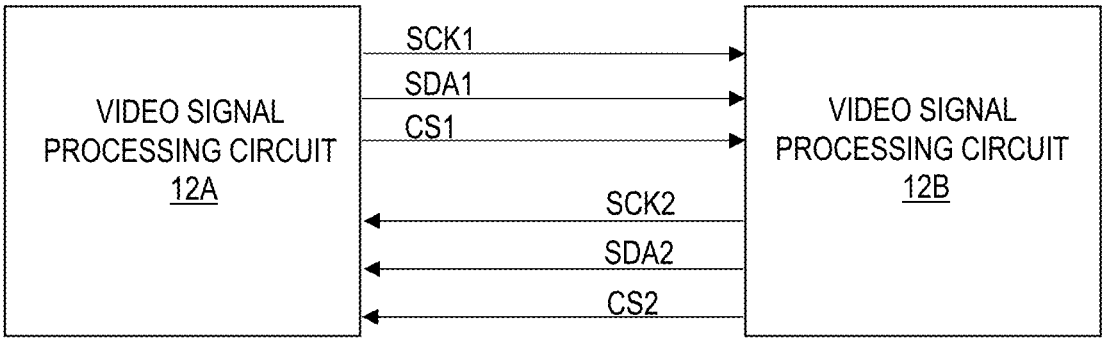
FIG. 24 illustrates examples of data communicated between video signal processing circuits.

FIG. 24 illustrates examples of data communicated between the video signal processing circuits 12A and 12B. The video signal processing circuit 12A sends the video signal processing circuit 12B a data signal SDA1 specifying provisional luminance values using a clock signal SCK1 and a control signal CS1. The video signal processing circuit 12B sends the video signal processing circuit 12A a data signal SDA2 specifying provisional luminance values using a clock signal SCK2 and a control signal CS2. The signal transmission lines can be reduced by sharing one or more of the signal lines between the video signal processing circuits 12A and 12B.

Figure 25:
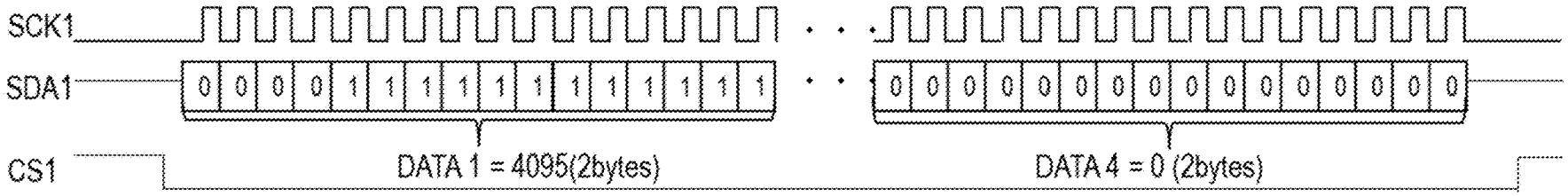
FIG. 25 illustrates examples of waveforms of the clock signal, the data signal, and the control signal in FIG. 24.

FIG. 25 illustrates examples of waveforms of the clock signal SCK1, the data signal SDA1, and the control signal CS1 in FIG. 24. The data signal SDA1 is an example of the data signal for the signal processing circuit 12A to send data on four border backlight blocks to the signal processing circuit 12B. In the example of FIG. 25, each of the provisional luminance values for the four backlight blocks are transmitted in 16 bits and a provisional luminance value is expressed in 12-bit resolution.

In the foregoing example, each of the display region and the backlight region is divided into two regions and the divided regions are controlled by two video signal processing circuits. In another example, the number of regions divided from the display region and the backlight region and the number of video signal processing circuits can be three or more. Information on provisional luminance values is communicated between the video signal processing circuits controlling adjoining display regions and the backlight regions therefor.

Fifth Embodiment

Figure 26:
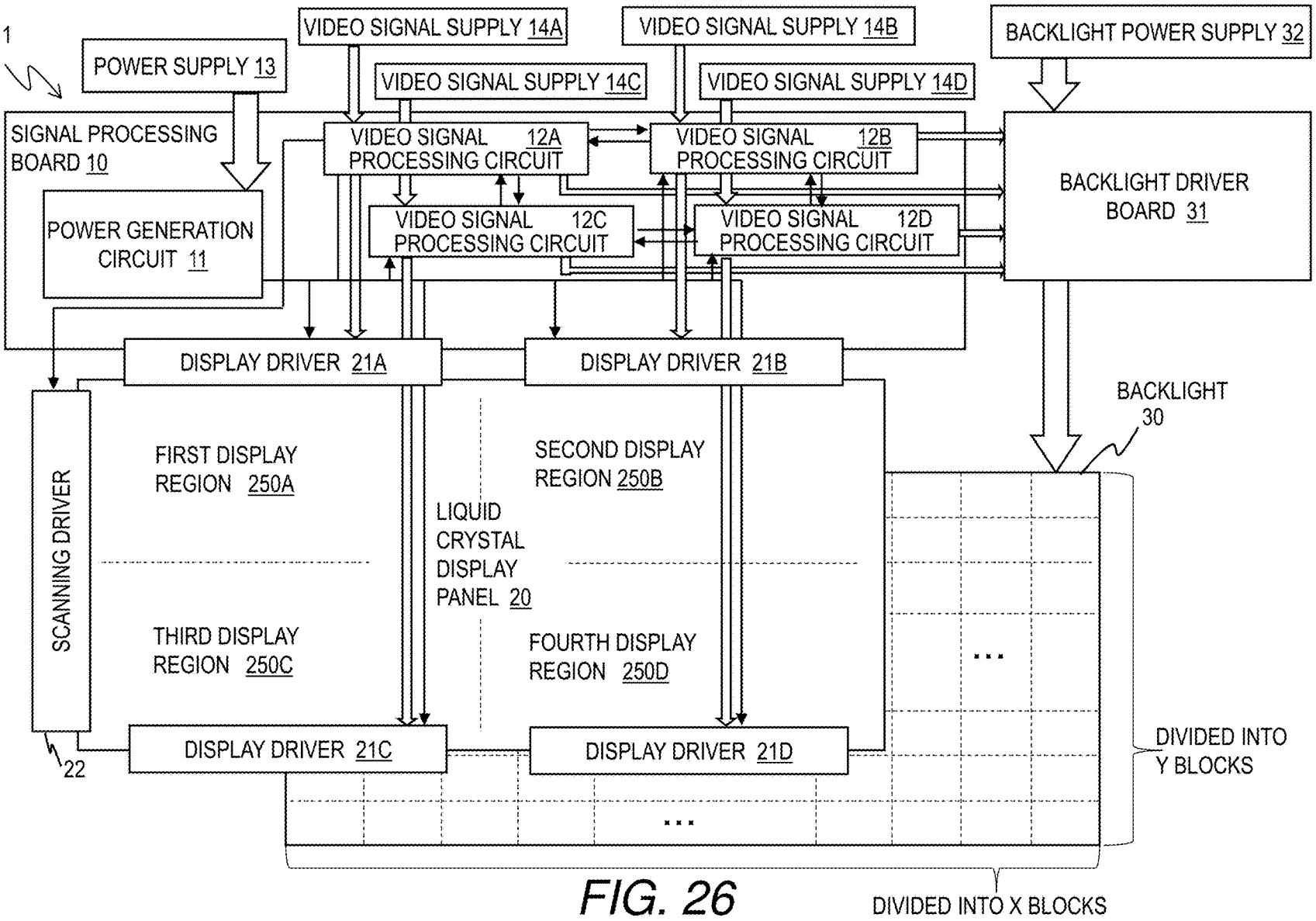
FIG. 26 illustrates a configuration example of a display device in still another embodiment of this specification.

FIG. 26 illustrates a configuration example of a display device in still another embodiment of this specification. The following mainly describes differences from the configuration example in FIG. 1. The liquid crystal display device 1 includes video signal supplies 14A to 14D and display drivers 21A to 21D. The signal processing board 10 includes video signal processing circuits 12A to 12D. The video signal processing circuits 12A to 12D are a first processing circuit to a fourth processing circuit.

The liquid crystal display panel 20 is divided into four display regions 250A to 250D. The video signal processing circuit 12A performs processing involved in displaying a picture in the first display region 250A; the video signal processing circuit 12B performs processing involved in displaying a picture in the second display region 250B; the video signal processing circuit 12C performs processing involved in displaying a picture in the third display region 2500; and the video signal processing circuit 12D performs processing involved in displaying a picture in the fourth display region 250D.

The video signal supply 14A supplies a video signal to the video signal processing circuit 12A; the video signal supply 14B supplies a video signal to the video signal processing circuit 12B; the video signal supply 14C supplies a video signal to the video signal processing circuit 120; and the video signal supply 14D supplies a video signal to the video signal processing circuit 12D.

The display driver 21A generates a data signal from the video signal sent from the video signal processing circuit 12A and supplies the data signal to the first display region 250A. The display driver 21B generates a data signal from the video signal sent from the video signal processing circuit 12B and supplies the data signal to the second display region 250B. The display driver 21C generates a data signal from the video signal sent from the video signal processing circuit 12C and supplies the data signal to the third display region 250C. The display driver 21D generates a data signal from the video signal sent from the video signal processing circuit 12D and supplies the data signal to the fourth display region 250D.

The video signal processing circuit 12A converts the data arrangement of the video signal input from the external to send it to the display driver 21A and generates and sends a timing signal for the display driver 21A and the scanning driver 22 to operate, using the power supplied from the power generation circuit 11. The video signal processing circuit 12A further generates a driving control signal for controlling the driving of the backlight 30 and sends the driving control signal to the backlight driver board 31.

The video signal processing circuit 12B converts the data arrangement of the video signal input from the external to send it to the display driver 21B and generates and sends a timing signal for the display driver 21B and the scanning driver 22 to operate, using the power supplied from the power generation circuit 11. The video signal processing circuit 12B further generates a driving control signal for controlling the driving of the backlight 30 and sends the driving control signal to the backlight driver board 31.

The video signal processing circuit 12C converts the data arrangement of the video signal input from the external to send it to the display driver 21C and generates and sends a timing signal for the display driver 21C and the scanning driver 22 to operate, using the power supplied from the power generation circuit 11. The video signal processing circuit 12C further generates a driving control signal for controlling the driving of the backlight 30 and sends the driving control signal to the backlight driver board 31.

The video signal processing circuit 12D converts the data arrangement of the video signal input from the external to send it to the display driver 21D and generates and sends a timing signal for the display driver 21D and the scanning driver 22 to operate, using the power supplied from the power generation circuit 11. The video signal processing circuit 12D further generates a driving control signal for controlling the driving of the backlight 30 and sends the driving control signal to the backlight driver board 31.

The backlight driver board 31 includes a backlight driver circuit and controls the lighting (luminance) of the backlight 30 in accordance with the driving control signals sent from the video signal processing circuits 12A to 12D.

Each of the video signal processing circuits 12A to 12D generates a driving control signal for controlling the luminance of individual blocks of the backlight 30 and sends the driving control signal to the backlight driver board 31. The backlight driver board 31 drives and controls the light sources of the backlight 30 so that the individual blocks light at the luminance values specified in the driving control signals from the video signal processing circuits 12A to 12D.

The video signal processing circuit 12A generates a timing signal for the display driver 21A and the scanning driver 22 in accordance with the input timing signal for the video signal and also, successively sends a signal (frame signal) of each video frame in the video signal to the display driver 21A. The video signal processing circuit 12B generates a timing signal for the display driver 21B and the scanning driver 22 in accordance with the input timing signal for the video signal and also, successively sends a signal (frame signal) of each video frame in the video signal to the display driver 21B.

The video signal processing circuit 12C generates a timing signal for the display driver 21C and the scanning driver 22 in accordance with the input timing signal for the video signal and also, successively sends a signal (frame signal) of each video frame in the video signal to the display driver 21C. The video signal processing circuit 12D generates a timing signal for the display driver 21D and the scanning driver 22 in accordance with the input timing signal for the video signal and also, successively sends a signal (frame signal) of each video frame in the video signal to the display driver 21D.

The video signal processing circuit 12A analyzes the video frame, generates a driving control signal for the backlight 30 to illuminate the first display region 250A from its behind based on the analysis result, and sends the driving control signal to the backlight 30. The video signal processing circuit 12B analyzes the video frame, generates a driving control signal for the backlight 30 to illuminate the second display region 250B from its behind based on the analysis result, and sends the driving control signal to the backlight 30.

The video signal processing circuit 12C analyzes the video frame, generates a driving control signal for the backlight 30 to illuminate the third display region 250C from its behind based on the analysis result, and sends the driving control signal to the backlight 30. The video signal processing circuit 12D analyzes the video frame, generates a driving control signal for the backlight 30 to illuminate the fourth display region 250D from its behind based on the analysis result, and sends the driving control signal to the backlight 30.

Figure 27:
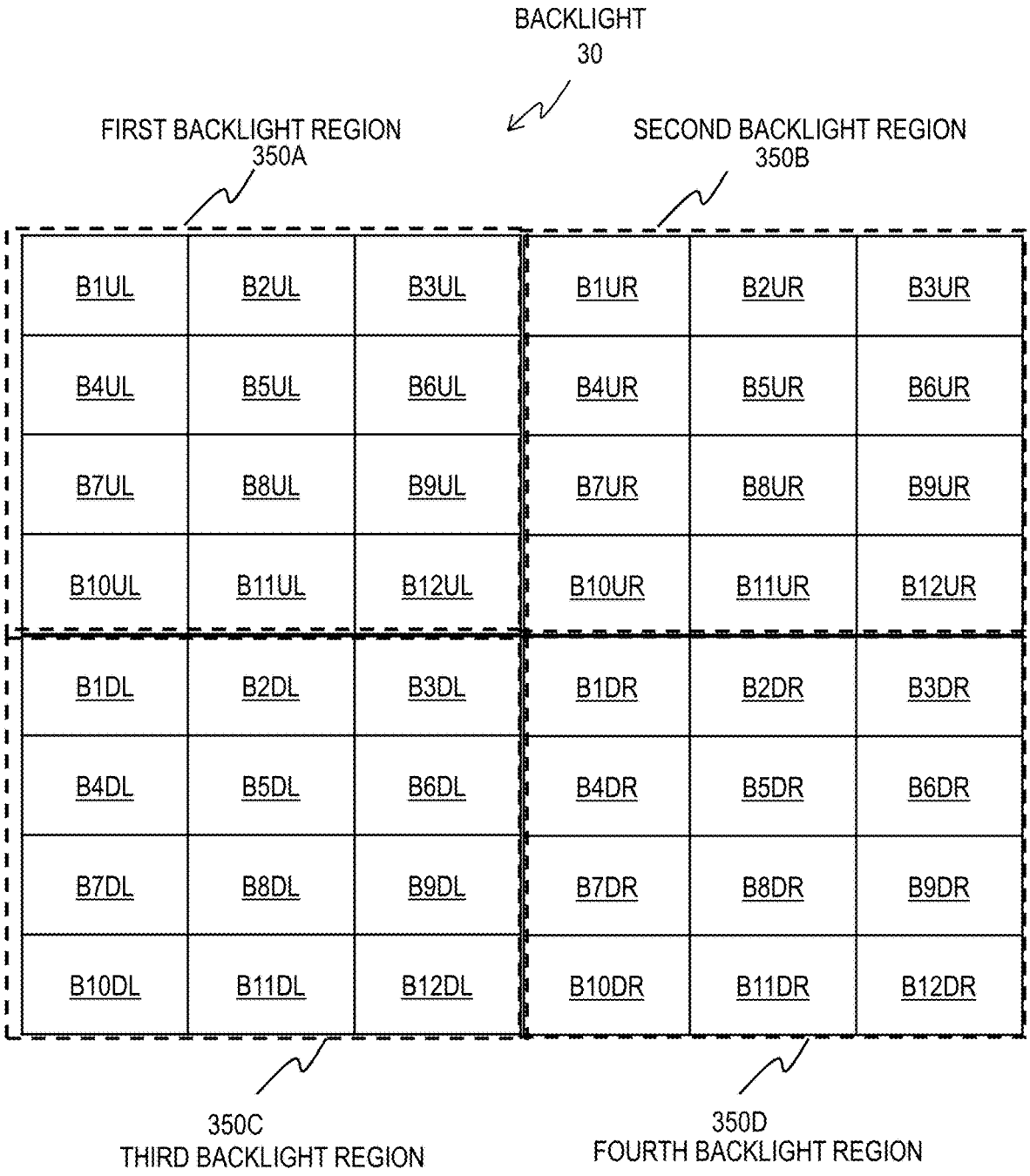
FIG. 27 schematically illustrates a configuration of a backlight.

FIG. 27 schematically illustrates the configuration of the backlight 30. The backlight 30 consists of an upper left first backlight region 350A, an upper right second backlight region 350B, a lower left third backlight region 350C, and a lower right fourth backlight region 350D.

The first backlight region 350A is directly beneath the first display region 250A. The first backlight region 350A is located behind and opposite to the first display region 250A to illuminate the first display region 250A. The second backlight region 350B is directly beneath the second display region 250B. The second backlight region 350B is located behind and opposite to the second display region 250B to illuminate the second display region 250B.

The third backlight region 350C is directly beneath the third display region 250C. The third backlight region 350C is located behind and opposite to the third display region 250C to illuminate the third display region 250C. The fourth backlight region 350D is directly beneath the fourth display region 250D. The fourth backlight region 350D is located behind and opposite to the fourth display region 250D to illuminate the fourth display region 250D.

The first backlight region 350A, the second backlight region 350B, the third backlight region 350C, and the fourth backlight region 350D are controlled by the video signal processing circuit 12A, the video signal processing circuit 12B, the video signal processing circuit 12C, and the video signal processing circuit 12D, respectively.

The first backlight region 350A consists of twelve backlight blocks B1UL to B12UL. The second backlight region 350B consists of twelve backlight blocks B1UR to B12UR. The third backlight region 350C consists of twelve backlight blocks B1DL to B12DL. The fourth backlight region 350D consists of twelve backlight blocks B1DR to B12DR. Although a case of twelve backlight blocks is described here, the number of backlight blocks is not limited to twelve; each backlight region can consist of N×M blocks (N and M are natural numbers). The number of blocks can be different among the backlight regions.

Hereinafter, communication of information on luminance values among video signal processing circuits is described. In the example described in the following, information on provisional luminance values for the border area between horizontally adjacent backlight regions is communicated first between the video signal processing circuits to complement necessary information. Next, information on provisional luminance values for the border area between vertically adjacent backlight regions is communicated between the video signal processing circuits to complement necessary information. The information about the border area between vertically adjacent backlight regions can be communicated first between video signal processing circuits and the information about the border area between horizontally adjacent backlight regions can be communicated thereafter.

FIGS. 28 to 31 illustrate examples of information communicated between video signal processing circuits. In the example described in the following, the provisional luminance value for the backlight block B10UR is 1.0 and the provisional luminance values for the other backlight blocks are 0.0.

Figure 28:
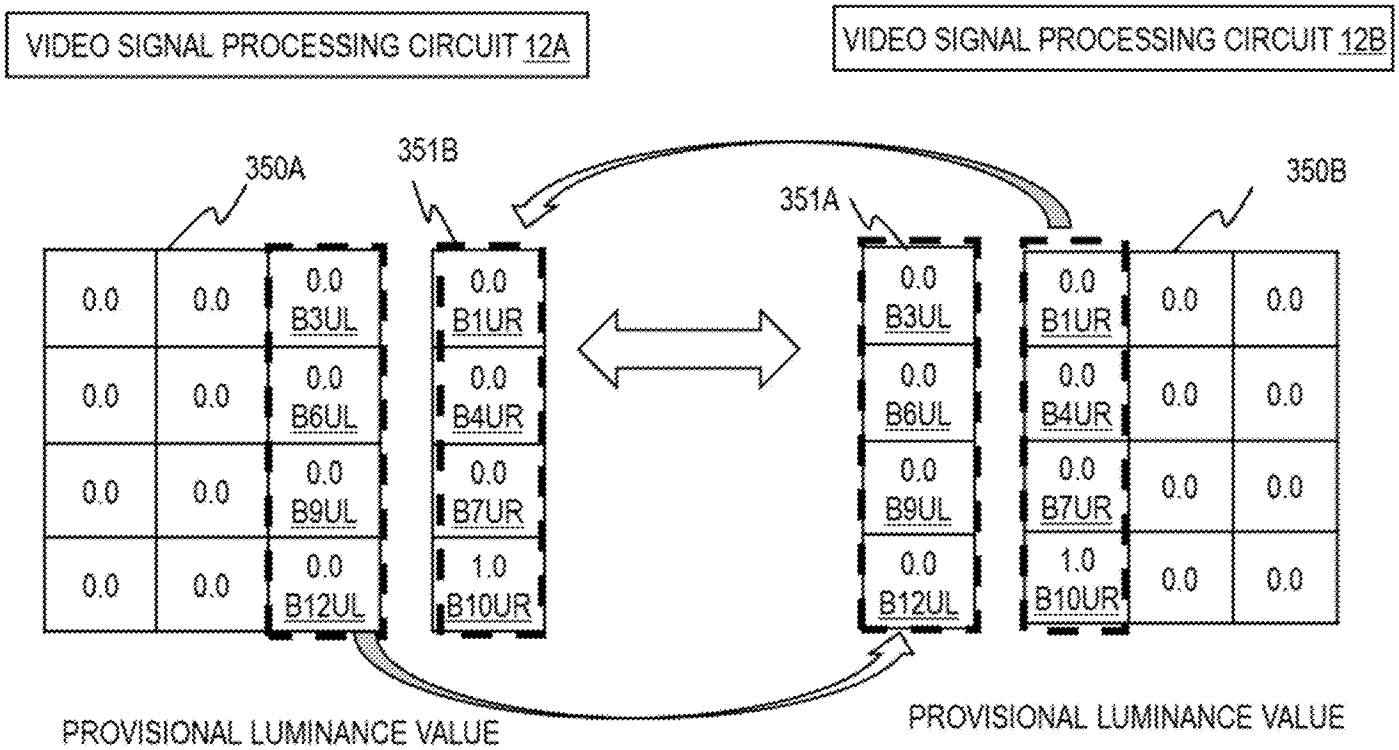
FIG. 28 illustrates an example of information on provisional luminance values communicated between video signal processing circuits.

FIG. 28 illustrates an example of information on the provisional luminance values communicated between the video signal processing circuits 12A and 12B. The video signal processing circuit 12A sends the video signal processing circuit 12B information on the provisional luminance values for the backlight block set 351A that is included in the first backlight region 350A and adjoining the second backlight region 350B. The backlight block set 351A consists of the backlight blocks B3UL, B6UL, B9UL, and B12UL.

The video signal processing circuit 12B sends the video signal processing circuit 12A information on the provisional luminance values for the backlight block set 351B that is included in the second backlight region 350B and adjoining the first backlight region 350A. The backlight block set 351B consists of the backlight blocks B1UR, B4UR, B7UR, and B10UR.

Figure 29:
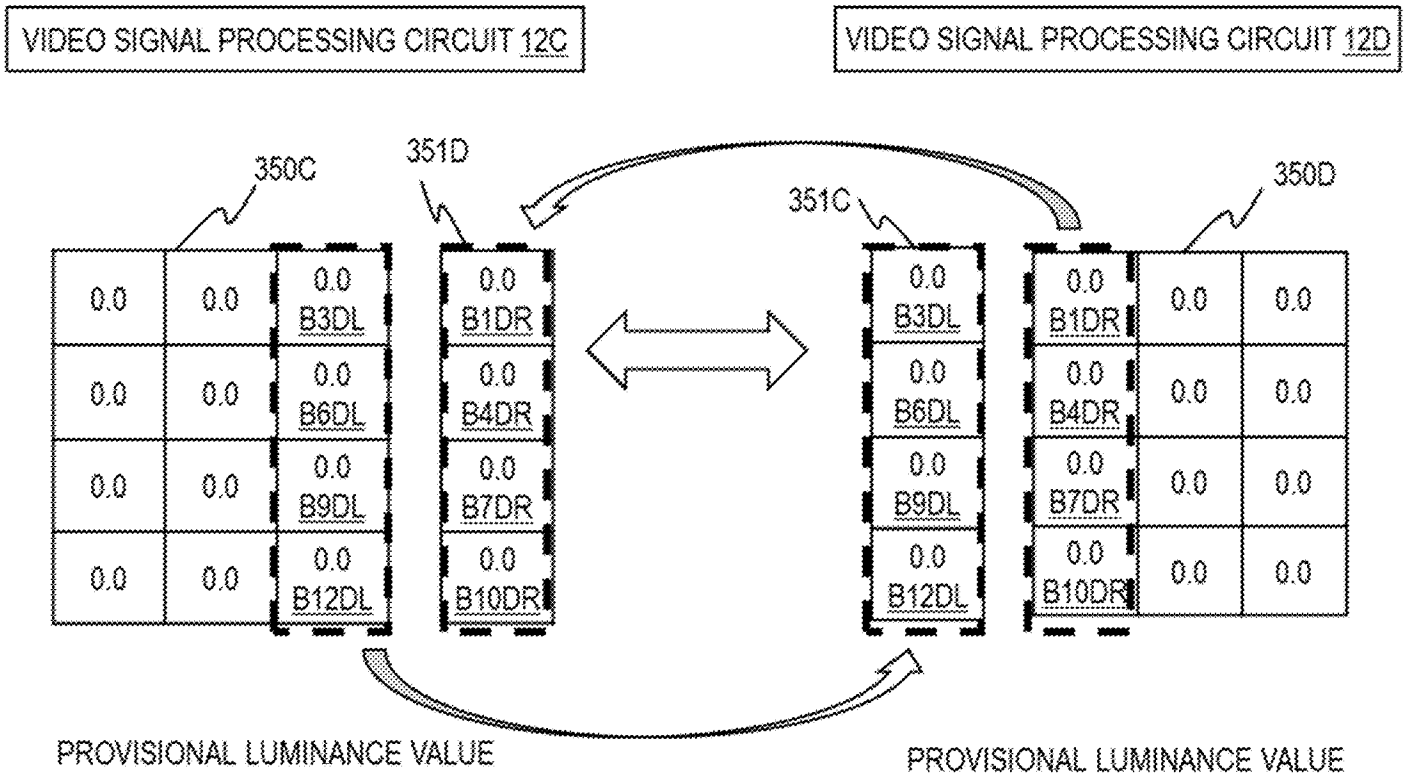
FIG. 29 illustrates an example of information on provisional luminance values communicated between video signal processing circuits.

FIG. 29 illustrates an example of information on the provisional luminance values communicated between the video signal processing circuits 12C and 12D. The video signal processing circuit 12C sends the video signal processing circuit 12D information on the provisional luminance values for the backlight block set 351C that is included in the third backlight region 350C and adjoining the fourth backlight region 350D. The backlight block set 351C consists of the backlight blocks B3DL, B6DL, B9DL, and B12DL.

The video signal processing circuit 12D sends the video signal processing circuit 12C information on the provisional luminance values for the backlight block set 351D that is included in the fourth backlight region 350D and adjoining the third backlight region 350C. The backlight block set 351D consists of the backlight blocks B1DR, B4DR, B7DR, and B10DR.

Figure 30:
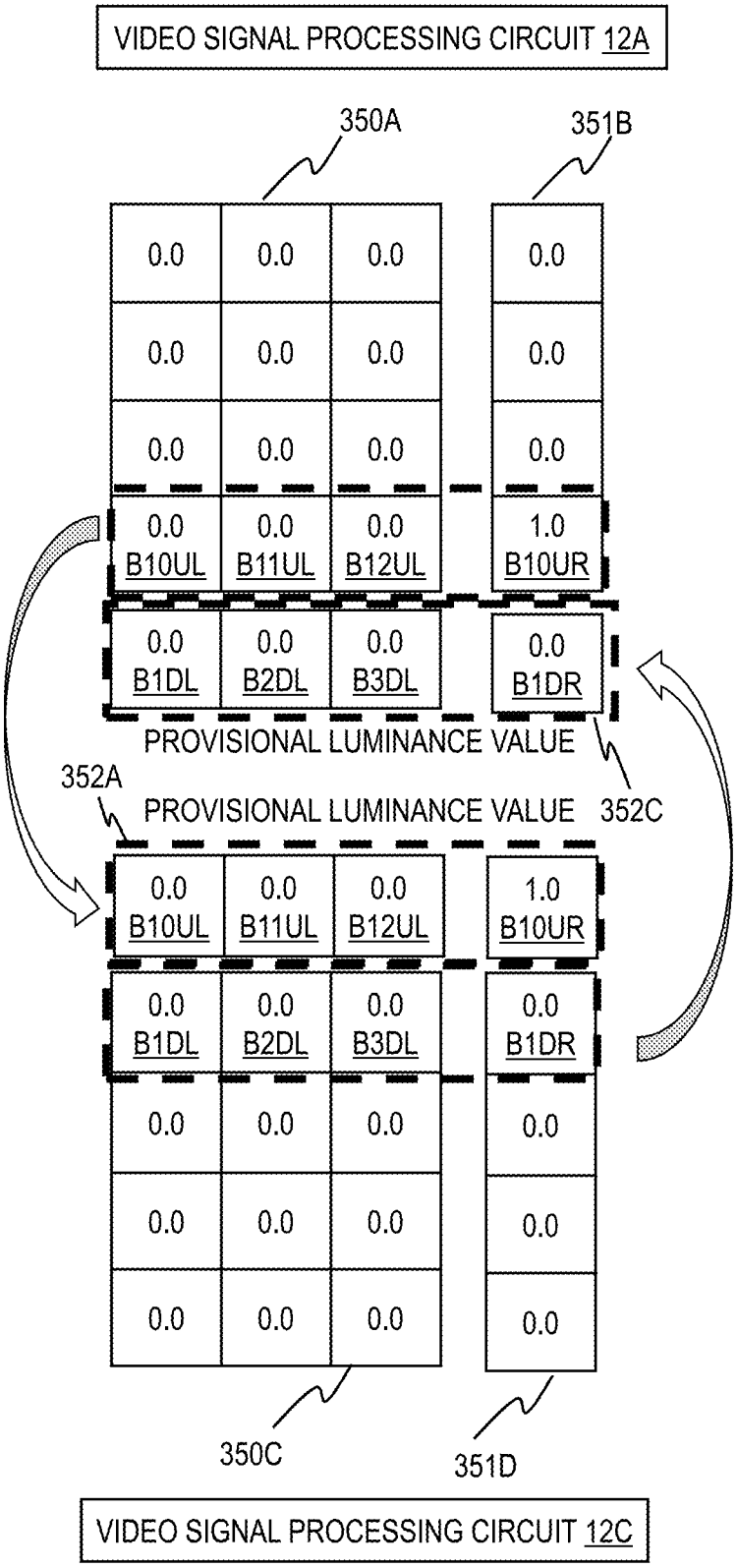
FIG. 30 illustrates an example of information on provisional luminance values communicated between video signal processing circuits.

FIG. 30 illustrates an example of information on the provisional luminance values communicated between the video signal processing circuits 12A and 12C. The video signal processing circuit 12A sends the video signal processing circuit 12C information on the provisional luminance values for the backlight block set 352A that is included in the first backlight region 350A or the backlight block set 351B and adjoining the third backlight region 350C or the backlight block set 351D. The backlight block set 352A consists of the backlight blocks B10UL, B11UL, B12UL, and B10UR.

The video signal processing circuit 12C sends the video signal processing circuit 12A information on the provisional luminance values for the backlight block set 352C that is included in the third backlight region 350C or the backlight block set 351D and adjoining the first backlight region 350A or the backlight block set 351B. The backlight block set 352C consists of the backlight blocks B1DL, B2DL, B3DL, and B1DR.

Figure 31:
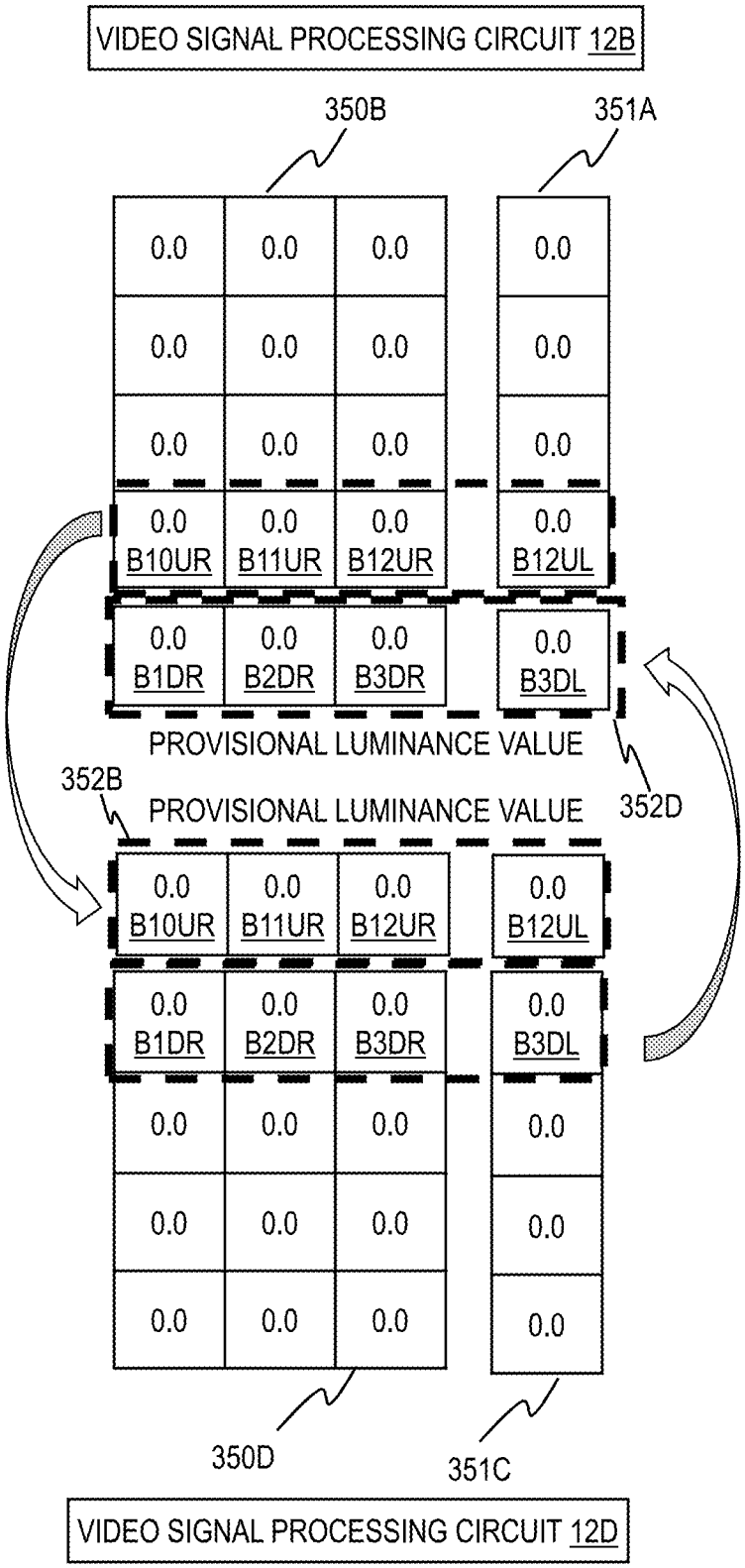
FIG. 31 illustrates an example of information on provisional luminance values communicated between video signal processing circuits.

FIG. 31 illustrates an example of information on the provisional luminance values communicated between the video signal processing circuits 12B and 12D. The video signal processing circuit 12B sends the video signal processing circuit 12D information on the provisional luminance values for the backlight block set 352B that is included in the second backlight region 350B or the backlight block set 351A and adjoining the fourth backlight region 350D or the backlight block set 351C. The backlight block set 352B consists of the backlight blocks B10UR, B11UR, B12UR, and B12UL.

The video signal processing circuit 12D sends the video signal processing circuit 12B information on the provisional luminance values for the backlight block set 352D that is included in the fourth backlight region 350D or the backlight block set 351C and adjoining the second backlight region 350B or the backlight block set 351A. The backlight block set 352D consists of the backlight blocks B1DR, B2DR, B3DR, and B3DL.

Through the foregoing processing, the video signal processing circuit 12A acquires the provisional luminance values for the backlight blocks B1UR, B4UR, B7UR, B10UR, B1DL, B2DL, B3DL, and B1DR that are adjacent to the first backlight region 350A. The video signal processing circuit 12B acquires the provisional luminance values for the backlight blocks B3UL, B6UL, B9UL, B12UL, B3DL, B1DR, B2DR, and B3DR that are adjacent to the second backlight region 350B.

The video signal processing circuit 12C acquires the provisional luminance values for the backlight blocks B1DR, B4DR, B7DR, B10DR, B10UL, B11UL, B12UL, and B10UR that are adjacent to the third backlight region 350C. The video signal processing circuit 12D acquires the provisional luminance values for the backlight blocks B3DL, B6DL, B9DL, B12DL, B12UL, B10UR, B11UR, and B12UR that are adjacent to the fourth backlight region 350D.

Each video signal processing circuit refers to provisional luminance values for other backlight regions received from other video signal processing circuits in calculating the adjustment coefficients for a backlight block set that is included in the backlight region assigned thereto and adjacent to other backlight regions. The method of determining each adjustment coefficient can be the same as described in the first embodiment.

FIG. 32 illustrates an example of the relation between a video frame and adjusted luminance values for the corresponding backlight blocks. In a video frame 851, only the region opposite to one backlight block is white and the other regions are black.

As described above, in the case where a backlight block of interest is adjoining a segmentation boundary in the backlight 30, each video signal processing circuit sends information on the provisional luminance values for the backlight blocks adjoining the boundary to another video signal processing circuits to complement necessary information.

In FIG. 32, only the region in the video frame corresponding to the backlight block B10UR is white and the other regions are black. The video signal processing circuit 12B refers to not only the provisional luminance values for the backlight blocks B7UR, B8UR, and B11UR in the second backlight region 350B but also the provisional luminance values for the backlight blocks B9UL and B12UL in the first backlight region 350A, the provisional luminance value for the backlight block B3DL in the third backlight region 350C, and the provisional luminance values for the backlight blocks B1DR and B2DR in the fourth backlight region (see FIG. 27) to determine the adjustment coefficient for the backlight block B10UR. The calculation method of the adjustment coefficient can be the one described in the first embodiment. As a result, the backlight block B10UR can be provided with an appropriate adjusted luminance value of 2.0.

As set forth above, embodiments of this disclosure have been described; however, this disclosure is not limited to the foregoing embodiments. Those skilled in the art can easily modify, add, or convert each element in the foregoing embodiments within the scope of this disclosure. A part of the configuration of one embodiment can be replaced with a configuration of another embodiment or a configuration of an embodiment can be incorporated into a configuration of another embodiment.

What is claimed is:

1. A display device comprising:
a backlight including a plurality of backlight blocks;
a display panel configured to display an image with light from the backlight; and
a controller,
wherein the controller is configured to:
acquire video data;
determine provisional luminance values for the plurality of backlight blocks based on the video data;
determine an adjustment coefficient for a backlight block of interest selected from the plurality of backlight blocks;
determine an adjusted luminance value for the backlight block of interest based on the provisional luminance value and the adjustment coefficient for the backlight block of interest; and
control the backlight block of interest in accordance with the adjusted luminance value, and
wherein, in determining the adjustment coefficient for the backlight block of interest, the controller is configured to:
calculate a statistic of provisional luminance values for a plurality of reference backlight blocks including backlight blocks adjacent to the backlight block of interest;
calculate a relative value of the statistic with respect to the provisional luminance value for the backlight block of interest; and
determine the adjustment coefficient for the backlight block of interest based on the relative value and a predefined function.

2. The display device according to claim 1,
wherein the controller is configured to determine a product of the provisional luminance value for the backlight block of interest and the adjustment coefficient to be the adjusted luminance value for the backlight block of interest, and
wherein the adjustment coefficient takes a value not smaller than 1.

3. The display device according to claim 1, wherein the relative value is a value obtained by dividing the statistic by the provisional luminance value for the backlight block of interest.

4. The display device according to claim 1,
wherein the plurality of backlight blocks include a first backlight block of interest the entire perimeter of which is surrounded by adjacent backlight blocks, and
wherein the plurality of reference backlight blocks for the first backlight block of interest consist of all of the backlight blocks adjacent to the first backlight block of interest.

5. The display device according to claim 1, wherein the statistic is a simple average.

6. The display device according to claim 1,
wherein the plurality of backlight blocks are disposed in a matrix,
wherein the statistic is a weighted average, and
wherein, in calculating the statistic, the controller is configured to assign a reference backlight block diagonally adjacent to the backlight block of interest a smaller weight than a weight assigned to a reference backlight block adjacent to the backlight block of interest in a row direction or a column direction.

7. The display device according to claim 1, wherein the plurality of reference backlight blocks include backlight blocks that are adjacent to backlight blocks adjacent to the backlight block of interest on an outer side with respect to the backlight block of interest.

8. The display device according to claim 1,
wherein the plurality of backlight blocks are disposed in a matrix, and
wherein the plurality of reference backlight blocks consist of backlight blocks adjacent to the backlight block of interest in a row direction and backlight blocks adjacent to the backlight block of interest in a column direction.

9. The display device according to claim 1,
wherein the controller is configured to select each of the plurality of backlight blocks as a backlight block of interest and determine an adjusted luminance value for each of the plurality of backlight blocks,
wherein disposition of reference backlight blocks is common to each backlight block of interest,
wherein the plurality of backlight blocks include a second backlight block of interest located at an end of the backlight, and
wherein reference backlight blocks for the second backlight block of interest include backlight blocks adjacent to the second backlight block of interest within the backlight and virtual backlight blocks adjacent to the second backlight block of interest outside the backlight.

10. The display device according to claim 9, wherein a provisional luminance value for a virtual backlight block is the same as a provisional luminance value for a reference backlight block adjacent to the virtual backlight block.

11. The display device according to claim 1,
wherein the controller is configured to:
determine a value smaller than 1 for the adjustment coefficient for the backlight block of interest by a method different from a method used in the determination based on the relative value and the function, in a case where predetermined conditions are satisfied; and
determine a value for the adjustment coefficient for the backlight block of interest based on the relative value and the function, in a case where the predetermined conditions are not satisfied, and
wherein the predetermined conditions are that provisional luminance values for the plurality of reference backlight blocks are maximum values and that a provisional luminance value for the backlight block of interest is smaller than a maximum value.

12. The display device according to claim 1, wherein the controller includes:

a first processing circuit configured to control a first display region of the display panel and a first backlight block group opposite to the first display region, a second processing circuit configured to control a second display region of the display panel and a second backlight block group opposite to the second display region, wherein the first processing circuit is configured to:

acquire information on provisional luminance values for second border backlight blocks that are adjoining the first backlight block group; and control the first backlight block group based on provisional luminance values for the first backlight block group and the second border backlight blocks, and wherein the second processing circuit is configured to:

acquire information on provisional luminance values for first border backlight blocks that are adjoining the second backlight block group; and control the second backlight block group based on provisional luminance values for the second backlight block group and the first border backlight blocks.

13. A method of controlling a backlight of a display device, the backlight including a plurality of backlight blocks, and the method comprising:

acquiring video data;

determining provisional luminance values for the plurality of backlight blocks based on the video data;

determining an adjustment coefficient for a backlight block of interest selected from the plurality of backlight blocks;

determining an adjusted luminance value for the backlight block of interest based on the provisional luminance value and the adjustment coefficient for the backlight block of interest; and controlling the backlight block of interest in accordance with the adjusted luminance value, wherein the determining an adjustment coefficient for the backlight block of interest includes:

calculating a statistic of provisional luminance values for a plurality of reference backlight blocks including backlight blocks adjacent to the backlight block of interest;

calculating a relative value of the statistic with respect to the provisional luminance value for the backlight block of interest; and determining the adjustment coefficient for the backlight block of interest based on the relative value and a predefined function.

* * * * *